US011454001B2

(12) United States Patent
Okada

(10) Patent No.: US 11,454,001 B2
(45) Date of Patent: Sep. 27, 2022

(54) EXCAVATOR

(71) Applicant: SUMITOMO HEAVY INDUSTRIES, LTD., Tokyo (JP)

(72) Inventor: Junichi Okada, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 105 days.

(21) Appl. No.: 17/022,497

(22) Filed: Sep. 16, 2020

(65) Prior Publication Data

US 2020/0407945 A1 Dec. 31, 2020

Related U.S. Application Data

(63) Continuation of application No. PCT/JP2019/012147, filed on Mar. 22, 2019.

(30) Foreign Application Priority Data

Mar. 22, 2018 (JP) ..... JP2018-054806

(51) Int. Cl.
*E02F 9/22* (2006.01)
*E02F 9/26* (2006.01)
*F15B 11/00* (2006.01)

(52) U.S. Cl.
CPC ..... *E02F 9/2203* (2013.01); *E02F 9/226* (2013.01); *E02F 9/265* (2013.01); *E02F 9/267* (2013.01); *E02F 9/268* (2013.01); *F15B 11/003* (2013.01)

(58) Field of Classification Search
CPC ..... E02F 9/2203; E02F 9/226; E02F 9/265; E02F 9/267; F15B 11/003
See application file for complete search history.

(56) References Cited

U.S. PATENT DOCUMENTS 4,955,283 A * 9/1990 Hidaka ..... F15B 13/015 91/461
6,253,658 B1 * 7/2001 Kimura ..... F15B 11/044 91/461
6,409,142 B1 * 6/2002 Kariya ..... F15B 13/01 137/460
9,518,370 B2 12/2016 Tsukamoto
2002/0073699 A1 6/2002 Nishimura et al.
(Continued)

FOREIGN PATENT DOCUMENTS

EP 1211359 6/2002
JP 2001-040713 2/2001
(Continued)

OTHER PUBLICATIONS

International Search Report for PCT/JP2019/012147 dated May 7, 2019.

*Primary Examiner* — Michael Leslie
*Assistant Examiner* — Matthew Wiblin
(74) *Attorney, Agent, or Firm* — IPUSA, PLLC

(57) ABSTRACT

An excavator includes a hydraulic oil holding circuit that is provided in an oil passage between a bottom-side oil chamber of a boom cylinder and a control valve and is closed when the boom is not lowered, and a controller. The controller releases a closed state of the hydraulic oil holding circuit when the excavator is in a predetermined unstable state, and controls a released state so that an acting velocity in a lowering direction of the boom becomes less than or equal to a predetermined reference.

16 Claims, 17 Drawing Sheets

(56) References Cited

U.S. PATENT DOCUMENTS

| | | | | |
|---|---|---|---|---|
| 2002/0157529 | A1* | 10/2002 | Kariya | F15B 13/01 91/461 |
| 2015/0096291 | A1 | 4/2015 | Takeuchi | |
| 2018/0347599 | A1* | 12/2018 | Terao | F15B 20/008 |

FOREIGN PATENT DOCUMENTS

| | | |
|---|---|---|
| JP | 2008-032187 | 2/2008 |
| JP | 2009-256891 | 11/2009 |
| JP | 2010-053969 | 3/2010 |
| JP | 2011-236562 | 11/2011 |
| JP | 2014-122510 | 7/2014 |
| JP | 2018-003285 | 1/2018 |

* cited by examiner

EXCAVATOR

CROSS REFERENCE TO RELATED APPLICATIONS

This application is a continuation application of International Application No. PCT/JP2019/012147 filed on Mar. 22, 2019 and designated the U.S., which is based upon and claims priority to Japanese Patent Application No. 2018-054806, filed on Mar. 22, 2018, the entire contents of each of which are hereby incorporated by reference.

BACKGROUND

1. Technical Field

The present disclosure relates to an excavator.

2. Description of the Related Art

In related art, there is a technique for automatically controlling a pressure of a boom cylinder (hereinafter, referred to as a "boom cylinder pressure"), to reduce an unstable action, such as lifting of an excavator or the like, not intended by an operator or the like.

However, in a case where the configuration employed holds a hydraulic oil in a bottom-side oil chamber of the boom cylinder in order to prevent dropping of the boom, for example, the pressure in the bottom-side oil chamber of the boom cylinder may not be adjusted appropriately.

SUMMARY

It is desirable to provide an excavator capable of simultaneously preventing dropping of the boom and automatically controlling the pressure of the boom cylinder.

According to one aspect of the embodiments, an excavator includes an undercarriage; an slewing upper structure rotatably mounted on the undercarriage; attachments, mounted on the slewing upper structure, and including a boom, an arm, and an end attachment; a boom cylinder configured to drive the boom; a first hydraulic mechanism section configured to operate according to an operation of the attachments; a second hydraulic mechanism section, provided in an oil passage between a bottom-side oil chamber of the boom cylinder and the first hydraulic mechanism section, and configured to close when a lowering operation of the boom is not performed; and a control device configured to release a closed state of the second hydraulic mechanism section when the excavator is in a predetermined unstable state, and control a released state so that an acting velocity in a lowering direction of the boom is less than or equal to a predetermined reference.

Other objects and further features of the present invention will be apparent from the following detailed description when read in conjunction with the accompanying drawings.

DETAILED DESCRIPTION

Hereinafter, embodiments of the present invention will be described, with reference to the drawings.

[Overview of Excavator]

First, an outline of an excavator 100 will be described, with reference to FIG. 1.

Figure 1:
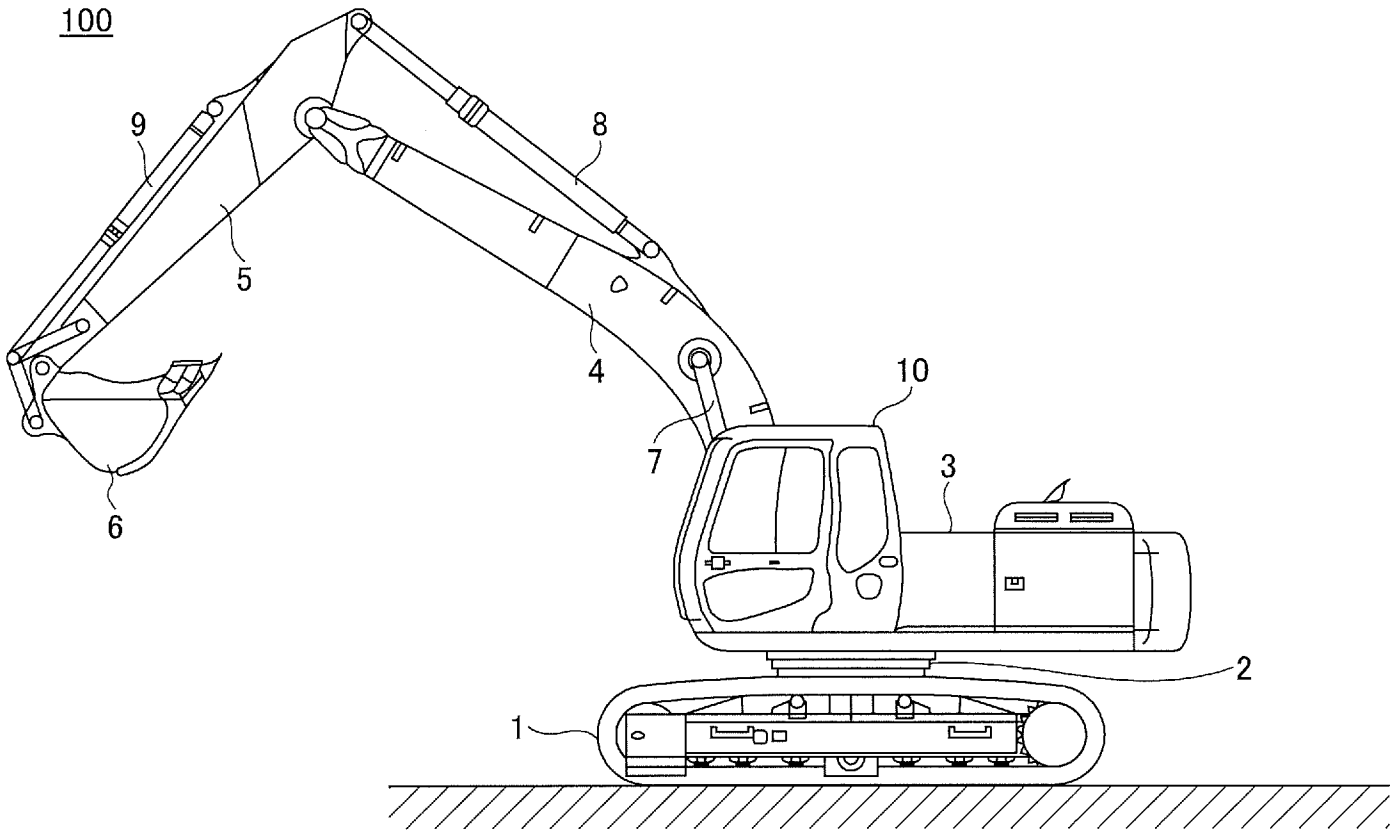
FIG. 1 is a side view illustrating an example of an excavator.

FIG. 1 is a side view illustrating an example the excavator (excavator 100) according to this embodiment.

The excavator 100 according to this embodiment includes an undercarriage 1, a slewing upper structure 3 that is rotatably mounted on the undercarriage 1 through a slewing mechanism 2, attachments including a boom 4, an arm 5, and a bucket 6, and a cabin 10 to be boarded by an operator.

The undercarriage 1 includes a pair of crawlers formed by right and left crawlers, for example, and the respective crawlers are hydraulically driven by crawler hydraulic motors 1A and 1B (refer to FIG. 2), to cause the excavator 100 to crawl.

Figure 2:
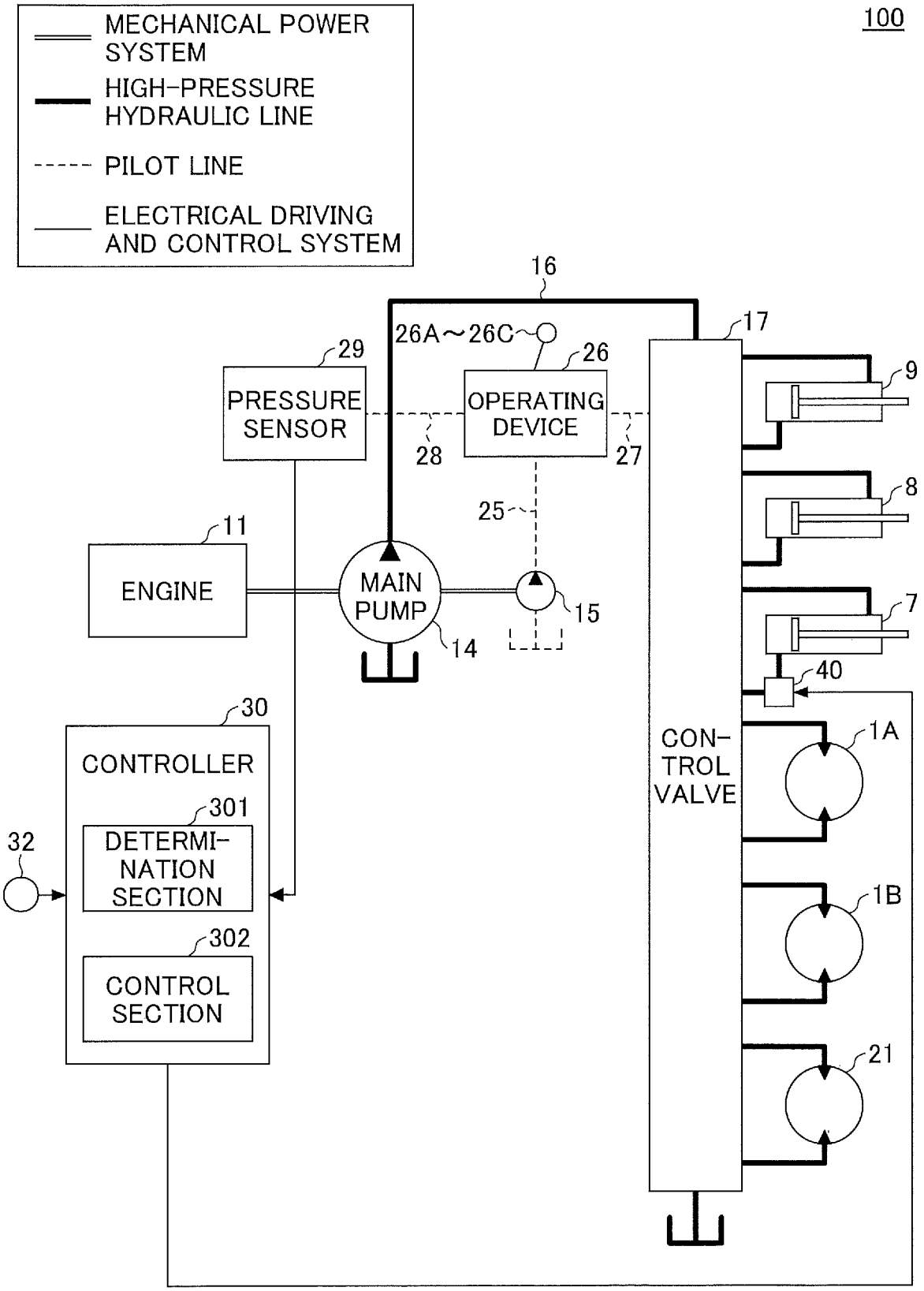
FIG. 2 is a block diagram illustrating an example of a configuration of the excavator.

The slewing upper structure 3 swings with respect to the undercarriage 1, by being driven by a swing hydraulic motor 21 (refer to FIG. 2).

The boom 4 is pivotally mounted at a front center of the slewing upper structure 3 and is able to pitch, the arm 5 is pivotally mounted at a tip end of the boom 4 and is able to swing up and down, and the bucket 6 is pivotally mounted at a tip end of the arm 5 and is able to swing up and down.

The bucket 6 (an example of an end attachment) is mounted on the end of the arm 5 in a manner suitably replaceable according to an operation content of the excavator 100. For this reason, the bucket 6 may be replaced with a different type of bucket, such as a large bucket, a slope bucket, a dredger bucket, or the like, for example. In addition, the bucket 6 may be replaced with a different type of end attachment, such as an agitator, a breaker, or the like, for example.

The boom 4, the arm 5, and the bucket 6 are respectively hydraulically driven by a boom cylinder 7, an arm cylinder 8, and a bucket cylinder 9 that are provided as hydraulic actuators.

The cabin 10 is a craneman's house that is boarded by the operator, and is mounted at a front left of the slewing upper structure 3.

[Basic Configuration of Excavator]

Next, a basic configuration of the excavator 100 according to this embodiment will be described, with reference to FIG. 2 in addition to FIG. 1.

FIG. 2 is a block diagram illustrating an example of the configuration of the excavator 100 according to this embodiment.

In FIG. 2, a double line indicates a mechanical power system, a bold solid line indicates a high-pressure hydraulic line, a broken line indicates a pilot line, and a thin solid line indicates an electrical driving and control system.

<Hydraulic Driving System of Excavator>

As described above, a hydraulic driving system according to this embodiment includes the crawler hydraulic motors 1A and 1B, the swing hydraulic motor 21, the boom cylinder 7, the arm cylinder 8, and the bucket cylinder 9 for hydraulically driving elements to be driven, such as the undercarriage 1, the slewing upper structure 3, the boom 4, the arm 5, the bucket 6, or the like, respectively. Hereinafter, some or all of the crawler hydraulic motors 1A and 1B, the swing hydraulic motor 21, the boom cylinder 7, the arm cylinder 8, and the bucket cylinder 9 may be referred to as a "hydraulic actuator" for the sake of convenience. The hydraulic driving system of the excavator 100 according to this embodiment also includes an engine 11, a main pump 14, a control valve 17, and a hydraulic oil holding circuit 40.

The hydraulic actuators other than the boom cylinder 4 may be replaced by electric actuators. For example, the swing hydraulic motor 21 may be replaced by a swing motor that electrically drives the slewing mechanism 2 (slewing upper structure 3).

The engine 11 is a driving source of the excavator 100, and is mounted at a rear portion of the slewing upper structure 3, for example. The engine 11 is a diesel engine that uses a light oil as the fuel, for example. The main pump 14 and a pilot pump 15 are connected to an output shaft of the engine 11.

The main pump 14 is mounted at the rear portion of the slewing upper structure 3, for example, and supplies a hydraulic oil to the control valve 17 through a high-pressure hydraulic line 16. The main pump 14 is driven by the engine 11, as described above. The main pump 14 is a variable capacity hydraulic pump, for example, and an angle (tilt angle) of a swash plate is controlled by a regulator under a control of the controller 30, thereby adjusting a stroke length of a piston and adjusting (controlling) a discharge flow rate (discharge pressure).

The main pump 14 may be driven by power from a power source other than the engine 11. For example, the main pump 14 may be driven by an electric motor in place of, or in addition to, the engine 11. In this case, the excavator 100 may be mounted with the other power source that supplies the power to the main pump 14, in place of or in addition to the engine 11. The other power source may include a storage device, such as a battery, a capacitor, or the like chargeable by the power supplied from the electric motor or an external commercial power supply, a fuel cell, or the like, for example.

The control valve 17 (an example of a first hydraulic mechanism section) is mounted at a center portion of the slewing upper structure 3, for example, and is a hydraulic control device for controlling the hydraulic driving system according to an operator's operation performed with respect to an operating device 26. More particularly, the control valve 17 controls the supply and discharge of the hydraulic oil to each of the hydraulic actuators according to the operator's operation performed with respect to the operating device 26. The crawler hydraulic motors 1A and 1B, the boom cylinder 7, the atm cylinder 8, the bucket cylinder 9, the swing hydraulic motor 21, or the like are connected to the control valve 17 through the high-pressure hydraulic line. The control valve 17 is provided between the main pump 14 and each of the hydraulic actuators, and includes a plurality of hydraulic control valves, that is, directional control valves, which control the flow rate and flow direction of the hydraulic oil supplied from the main pump 14 to each of the hydraulic actuators. For example, the control valve 17 includes a directional control valve 17A (refer to FIG. 9 and FIG. 10) for a boom, which will be described later.

In addition, the excavator 100 may be remotely operated. In this case, the control valve 17 controls the hydraulic driving system according to a signal (hereinafter referred to as a "remote operation signal") related to the operation of the hydraulic actuator received from an external device through a communication device mounted on the excavator 100. A target hydraulic actuator to be operated, and contents of a remote operation (for example, an operating direction, an operating amount, or the like) related to the target hydraulic actuator to be operated, are prescribed by the remote operation signal. For example, the controller 30 outputs a control command, corresponding to the remote operation signal, to a proportional valve (hereinafter referred to as a "operating proportional valve for operation") that is arranged in the hydraulic line (pilot line) and connects the pilot pump 15 and the control valve 17. Hence, the operating proportional valve can cause a pilot pressure corresponding to the control command, that is, the pilot pressure according to the contents of the remote operation, to act on the control valve 17. For this reason, the control valve 17 can realize the operation of the hydraulic actuator according to the contents of the remote operation prescribed by the remote operation signal.

Moreover, the excavator 100 may perform an autonomous operation (work) regardless of the operator's operation, the remote operation, or the like, for example. In this case, the control valve 17 controls the hydraulic driving system according to a driving command (hereinafter referred to as an "autonomous driving command") that is generated by an autonomous control device (for example, the controller 30 or the like), to operate the hydraulic actuators of the excavator 100 and realize the autonomous operation of the excavator 100. The target hydraulic actuators to be operated, and the operation contents (for example, the operating direction, the operating amount, or the like) related to the target hydraulic actuators to be operated, are prescribed by the autonomous driving command. In other words, the control valve 17 controls the hydraulic driving system according to the autonomous hydraulic actuator operation performed by the autonomous control device. For example, the autonomous control device outputs a control command corresponding to an autonomously generated driving command to the operating proportional valve. Hence, the operating proportional valve can cause the pilot pressure corresponding to the control command, that is, the pilot pressure according to the operation contents related to the hydraulic actuator prescribed by the driving command, to act on the control valve 17. For this reason, the control valve 17 can realize the operation of the hydraulic actuator according to the operation contents prescribed by the driving command corresponding to the autonomous operation generated by the autonomous control device.

The hydraulic oil holding circuit 40 (an example of a second hydraulic mechanism section) is provided in the high-pressure hydraulic line (an example of an oil passage) between a bottom-side oil chamber of the boom cylinder 7 and the control valve 17. The hydraulic oil holding circuit 40 basically tolerates the flow of the hydraulic oil into the bottom-side oil chamber of the boom cylinder 7 when an operation in a lowering direction of the boom 4 (hereinafter referred to as a "boom lowering operation") is not performed, but blocks the flow of the hydraulic oil out of the bottom-side oil chamber of the boom cylinder 7 and holds the hydraulic oil in the bottom-side oil chamber.

Hereinafter, this function is referred to as a "hydraulic oil holding function". In this example, "a case where the boom lowering operation is not performed" not only includes the case where the boom lowering operation is not performed with respect to the operating device 26, but also a case where the operation contents corresponding to the boom lowering operation are not prescribed by the remote operation signal or the autonomous driving command. Hereinafter, the same applies to "a case where the boom raising operation is performed". Accordingly, even in a case where a hydraulic oil leak (hereinafter referred to as a "hose burst" for the sake of convenience) occurs due to a burst of a hose or the like in the high-pressure hydraulic line on a downstream side of the hydraulic oil holding circuit 40 when the boom cylinder 7 is regarded as an the upstream side, it is possible to reduce the drop (dropping velocity) of the boom 4. Further, in the case where the boom lowering operation is performed, the hydraulic oil holding circuit 40 tolerates the discharge of the hydraulic oil from the bottom-side oil chamber of the boom cylinder 7 to the control valve 17. In other words, the hydraulic oil holding circuit 40 is linked to the operation state (operation contents) related to the boom 4, and switches between permitting and not permitting the discharge of the hydraulic oil from the bottom-side oil chamber of the boom cylinder 7. Moreover, the high-pressure hydraulic line connecting the hydraulic oil holding circuit 40 and the boom cylinder 7 is formed by a metal pipe or the like, for example. Accordingly, it is possible to reduce the leak of the hydraulic oil in the high-pressure hydraulic line between the hydraulic oil holding circuit 40 and the boom cylinder 7, and the burst or the like caused by a pressure increase of the hydraulic oil.

Further, the hydraulic oil holding circuit 40 may discharge the hydraulic oil from the bottom-side oil chamber of the boom cylinder 7 under a control of the controller 30, even in a case where the boom lowering operation is not performed. In other words, the hydraulic oil holding function of the hydraulic oil holding circuit 40 may be temporarily canceled under the control of the controller 30. That is, the link of the hydraulic oil holding circuit 40 with the operation state (operation contents) of the boom 4 may be temporarily canceled under the control of the controller 30, to discharge the hydraulic oil in the bottom-side oil chamber of the boom cylinder 7.

The configuration and operation of the hydraulic oil holding circuit 40 will be described later in more detail (refer to FIG. 9 through FIG. 11).

<Operating System of Excavator>

An operating system of the excavator 100 according to this embodiment includes the pilot pump 15, the operating device 26, and a pressure sensor 29. The pilot pump 15 is mounted at the rear portion of the slewing upper structure 3, for example, and supplies the pilot pressure to the operating device 26 through a pilot line 25. The pilot pump 15 is a fixed capacitive hydraulic pump, for example, and is driven by the engine 11 as described above.

The operating device 26 includes lever devices 26A and 26B, and a pedal device 26C. The operating device 26 is provided near an operator's seat inside the cabin 10, and is an operating means manipulated by the operator to operate the respective elements to be driven (the right and left crawlers of the undercarriage 1, the slewing upper structure 3, the boom 4, the arm 5, the bucket 6, or the like). In other words, the operating device 26 is the operating means for operating the respective hydraulic actuators (the crawler hydraulic motors 1A and 1B, the boom cylinder 7, the arm cylinder 8, the bucket cylinder 9, the swing hydraulic motor 21, or the like) that drive the respective elements to be driven.

The operating device 26 is a hydraulic pilot type. More particularly, the operating device 26 (the lever devices 26A and 26B, and the pedal device 26C) is connected to the control valve 17 through a hydraulic line 27. Thus, the control valve 17 receives the pilot signal (pilot pressure) corresponding to the operation state of the undercarriage 1, the slewing upper structure 3, the boom 4, the arm 5, the bucket 6, or the like on the operating device 26. For this reason, the control valve 17 can drive each of the hydraulic actuators according to the operation state of the operating device 26. The operating device 26 is also connected to the pressure sensor 29 through a hydraulic line 28.

In addition, the operating device 26 may be an electrical type. In this case, the operating device 26 outputs an electrical signal (hereinafter referred to as an "operation signal") according to the operation state (for example, the operation contents such as the operating direction and the operating amount). Moreover, the operation signal is input to the controller 30, which will be described later, and the controller 30 outputs the control command corresponding to the operation signal to the operating proportional valve. Accordingly, the proportional valve can apply the pilot pressure corresponding to the operation command, that is, the pilot pressure according to the operation contents of the operating device 26. For this reason, the control valve 17 can realize the operation of the hydraulic actuator according to the operation contents of the operating device 26.

The lever devices 26A and 26B are arranged on the left and right sides, respectively, when viewed from the operator seated in the operator's seat inside the cabin 10, and are configured so that the respective operation levers can tilt frontward and rearward and also leftward and rightward with reference to a neutral state (a state where no input operation is made by the operator). Hence, one of the slewing upper structure 3 (the swing hydraulic motor 21), the boom 4 (the boom cylinder 7), the arm 5 (the arm cylinder 8), and the bucket 6 (the bucket cylinder 9) may be set arbitrarily as an operating target, according to the frontward or rearward tilt and the leftward or rightward tilt of the operation lever in the lever device 26A, and the frontward or rearward tilt and the leftward or rightward tilt of the operation lever in the lever device 26B, respectively.

Further, the pedal device 26C, having the undercarriage 1 (the crawler hydraulic motors 1A and 1B) as an operation target thereof, is arranged on a floor in front of the operator seated in operator's seat inside the cabin 10, when viewed from the operator, and includes an operation pedal that is configured to be stepped on by the operator.

In the case where the excavator 100 is operated remotely or the excavator 100 operates autonomously, the operating device 26 may be omitted.

The pressure sensor 29 is connected to the operating device 26 through the hydraulic line 28 as described above, and detects the pilot pressure on the secondary side of the operating device 26, that is, the pilot pressure corresponding to the operation state of each of the elements to be driven in the operating device 26. The pressure sensor 29 is connected to the controller 30, and the pressure signal (pressure detection value) corresponding to the operation state of the undercarriage 1, the slewing upper structure 3, the boom 4, the arm 5, the bucket 6, or the like in the operating device 26 is input to the controller 30. Accordingly, the controller 30 can grasp the operation states of the undercarriage 1, the slewing upper structure 3, and the attachments (the boom 4, the arm 5, and the bucket 6) of the excavator 100.

In the case where the operating device 26 is the electrical type, the case where the operating device 26 is omitted under a precondition of the remote operation or autonomous operation of the excavator 100, or the like, the pressure sensor 29 may be omitted. The control system of the excavator 100 in this example includes the controller 30, an unstable action determination sensor 32, and the hydraulic oil holding circuit 40.

The controller 30 is the main control device for controlling and driving the excavator 100. Functions of the controller 30 may be implemented by arbitrary hardware, or a combination of hardware and software. For example, the controller 30 is mainly formed by a microcomputer including a processor such as a Central Processing Unit (CPU) or the like, a memory device such as a Random Access Memory (RAM) or the like, an auxiliary storage device such as a Read Only Memory (ROM) or the like, an input and output interface device, or the like.

In this embodiment, the controller 30 determines the presence or absence of an unstable action (or a predetermined unstable state) of the excavator 100 (hereinafter simply referred to as an "unstable action") not intended by the operator who operates the operating device 26, the operator who performs the remote operation, the autonomous control device, or the like (hereinafter referred to as the "operator or the like" for the sake of convenience). In other words, the controller 30 determines whether or not the unstable action of the excavator 100, undesirable to the operator or the like, is generated. When the controller 30 determines that the unstable action is generated, the controller 30 automatically controls the operation of the attachments of the excavator 100 (more particularly, as will be described below, the boom cylinder 7 that drives the boom 4) to reduce the unstable action. In other words, the controller 30 compensates for the anticipated actions of the attachments when the unstable action of the excavator 100 is generated. In this case, the operation of the attachment includes the operation of the attachment according to the operation related to the attachment. In addition, the operation of the attachment includes the operation of the attachment (for example, the operation based on the force acting from the bucket 6, the force acting from the slewing upper structure 3, or the like) that is unrelated to the operation related to the attachment (for example, for the case where the operation related to the attachment is not performed). Hence, the unstable action of the excavator 100 that is generated, can be reduced.

The unstable action of the excavator 100 includes a lifting action (hereinafter referred to as a "rear portion lifting action" for the sake of convenience) in which the rear portion of the excavator 100 is lifted due to an excavating reaction force or the like, for example. In addition, the unstable action of the excavator 100 includes a vibrating action of a vehicle body (the undercarriage 1, the slewing mechanism 2, the slewing upper structure 3, or the like) induced by a change or the like in a moment of inertia during an in-air operation of the attachment of the excavator 100 (operation in a state where the bucket 6 is not grounded), for example. Details of the unstable action of the excavator 100 will be described later (refer to FIG. 3A through FIG. 6).

The controller 30 includes a determination section 301 and a control section 302, as functional sections implemented by executing one or more programs installed in the auxiliary storage device by the CPU, for example.

The unstable action determination sensor 32 is used to determine the presence or absence of the unstable action of the excavator 100, and detects various states of the excavator 100 and various states surrounding the excavator 100. For example, the unstable action determination sensor 32 may include angle sensors for detecting an attitude angle of the boom 4 (hereinafter referred to as a "boom angle"), an attitude angle of the arm 5 (hereinafter referred to as an "arm angle"), and an attitude angle of the bucket 6 (hereinafter referred to as a "bucket angle"), or the like. The unstable action determination sensor 32 may also include a pressure sensor or the like for detecting a hydraulic pressure state in the hydraulic actuator, such as the pressure in the bottom-side oil chamber and a rod-side oil chamber of the hydraulic cylinder, for example. In addition, the unstable action determination sensor 32 may include a sensor for detecting the operation state of each of the undercarriage 1, the slewing upper structure 3, and the attachments. For example, the unstable action determination sensor 32 may include an acceleration sensor mounted on an attachment, an angular acceleration sensor, a three-axis acceleration sensor, a six-axis sensor including a three-axis angular velocity sensor, an Inertial Measurement Unit (IMU), or the like mounted on the undercarriage 1, the slewing upper structure 3, or the attachment. The unstable action determination sensor 32 may include a distance sensor, an image sensor, or the like for detecting a relative position relationship of the excavator 100 with respect to the surrounding terrain, obstacle, or the like.

The determination section 301 determines whether or not the unstable action of the excavator 100 is generated, based on sensor information related to various states of the excavator 100 input from the pressure sensor 29 and the unstable action determination sensor 32.

For example, the determination section 301 determines the generation of the rear portion lifting action of the excavator 100, based on the inclination of the vehicle body in the front and rear directions, that is, an output of a sensor capable of outputting angle related information related to the inclination angle in a pitch direction. In this case, the unstable action determination sensor 32 includes a sensor capable of outputting the angle related information (for example, the inclination angle, the angular velocity, the angular acceleration, or the like) related to the inclination angle of the vehicle body in the pitch direction. For example, the unstable action determination sensor 32 may include an inclination sensor (angle sensor), an angular velocity sensor, a six-axis sensor, an IMU, or the like mounted on the undercarriage 1 or the slewing upper structure 3. More particularly, the determination section 301 can determine that the lifting action is generated when the detection value of the inclination angle, the angular velocity, or the angular acceleration of the excavator 100 in the pitch direction becomes greater than or equal to a predetermined threshold value. This is because the inclination angle, the angular velocity, and the angular acceleration of the excavator 100 in the pitch direction assume values that are large to a certain extent when the lifting action is generated. Then, the determination section 301 can determine whether a front portion lifting action or the rear portion lifting action is generated, based on a generating direction of the inclination angle, the angular velocity, or the angular acceleration, that is, whether the inclination is a rearward inclination or a frontward inclination with reference to a pitch axis as the center.

Further, the determination section 301 determines the generation of the rear portion lifting action of the excavator 100, based on an output of a sensor capable of outputting the relative position information of the excavator 100 with the surrounding terrain, obstacle, or the like, for example. In this case, the unstable action determination sensor 32 includes the sensor capable of outputting the relative position information of the excavator 100 and the surrounding terrain, obstacle, or the like. For example, the unstable action determination sensors 32 includes a millimeter-wave radar, a Light Detection and Ranging (LIDAR), a monocular camera, a stereo camera, or the like. More particularly, the determination section 301 may determine whether or not the rear portion lifting action of the excavator 100 is generated, based on whether or not a position of a predetermined reference object in front when viewed from the excavator 100 moved approximately in an upward direction. This is because, when the rear portion of the excavator 100 is lifted, the front portion of the excavator 100 approaches the ground, and as a result, the reference object, such as the ground or the like in front when viewed from the excavator 100, moves relatively in the upward direction.

In addition, the determination section 301 may determine whether or not there is a possibility that the unstable action of the excavator 100 is generated, based on the sensor information related to the various states of the excavator 100 input from the pressure sensor 29 and the unstable action determination sensor 32. More particularly, the determination section 301 may determine whether or not a prescribed condition (hereinafter referred to as an "unstable action generating condition") under which the unstable action of the excavator 100 is generated, is satisfied, based on the sensor information related to the various states of the excavator 100.

For example, the determination section 301 computes (estimates) a moment in the pitch direction acting on the vehicle body, based on an output of the sensor capable of outputting information related to the operation state and the attitude state of the attachment. When the computed (estimated) moment exceeds a threshold value prescribed as a lower limit of the moment in the pitch direction required for the generation of the unstable action, the determination section 301 determines that there is a possibility that the unstable action of the excavator 100 is generated. In this case, the unstable action determination sensor 32 includes the sensor capable of outputting the information related to the operation state or the attitude state of the attachment. For example, the unstable action determination sensor 32 includes an angle sensor (for example, a rotary encoder) for detecting a pitch angle (boom angle) at a connecting point between the slewing upper structure 3 and the boom 4 with respect to a reference plane of the boom 4, a relative pitch angle (arm angle) of the arm 5 with respect to the boom 4, and a relative pitch angle (bucket angle) of the bucket 6 with respect to the arm 5. Moreover, the unstable action determination sensor 32 includes a pressure sensor or the like for detecting the pressure in the rod-side oil chamber and the bottom-side oil chamber of the hydraulic cylinder (the boom cylinder 7, the arm cylinder 8, and the bucket cylinder 9), for example. Further, the unstable action determination sensor 32 includes an acceleration sensor, an angular velocity sensor, a six-axis sensor, an IMU, or the like mounted on the attachment, for example.

The control section 302 automatically controls (corrects) the operation of the attachment and reduces the unstable action of the excavator 100, when the determination section 301 determines that the unstable action is generated or there is a possibility that the unstable action is generated. More particularly, as will be described later, the control section 302 automatically controls (corrects) the operation of the attachment, by controlling (reducing) the pressure in the bottom-side oil chamber of the boom cylinder 7. In this case, the control section 302 cancels the hydraulic oil holding function of the hydraulic oil holding circuit 40. Accordingly, the control section 302 can discharge the hydraulic oil from the bottom-side oil chamber of the boom cylinder 7 and control the pressure, even when no boom lowering operation is performed through the operating device 26, the remote operation, or the autonomous control device (hereinafter referred to as "the control device 26 or the like"). In other words, the control section 302 cancels the hydraulic oil holding function of the hydraulic oil holding circuit 40, according to the state of the excavator 100 (more particularly, according to whether or not the unstable action of the excavator 100 is generated). Accordingly, the control section 302 can discharge the hydraulic oil from the bottom-side oil chamber of the boom cylinder 7 and control the pressure, regardless of the operation state of the boom 4 through the operating device 26 or the like (more particularly, regardless of whether or not the boom lowering operation is performed through the operating device 26 or the like). For this reason, the control section 302 can provide both the hydraulic oil holding function in the case where the unstable action of the excavator 100 is not generated, and an unstable action reducing function in the case where the unstable action of the excavator 100 is generated. Hereinafter, such a manner of control will be referred to as a "bottom relief control" for the sake of convenience.

Even when the hose burst occurs in the oil passage connected to the bottom-side oil chamber of the boom cylinder 7 in a state where the control section 302 cancels the hydraulic oil holding function of the hydraulic oil holding circuit 40 and controls (adjusts) the pressure in the bottom-side oil chamber of the boom cylinder 7, the control section 302 controls an acting velocity of the boom 4 in the lowering direction so that the acting velocity becomes small relative to a case where the hydraulic oil holding function is not provided (that is, a case where the hydraulic oil holding function of the hydraulic oil holding circuit 40 is completely canceled) becomes less than or equal to a predetermined reference. In this case, the acting velocity in the lowering direction of the boom 4 that is controlled, may be the acting velocity at each point in time or an average acting velocity within a certain time period, that is, a displacement or the like of the boom 4 in the lowering direction within a predetermined time, for example. The specific correction method and a detailed operation of the control section 302 will be described later (refer to FIG. 9 through FIG. 11).

In addition to rear portion lifting and vibrating actions, other types of unstable actions may be generated in the excavator 100. The unstable action of the excavator 100 may include a dragging operation (also referred to as a sliding operation) in which the excavator 100 is dragged frontward due to the excavating reaction force or the like, or the excavator 100 is dragged rearward due to a reaction force from the ground during a leveling operation or the like, for example. In addition, the unstable action of the excavator 100 may include the lifting action in which the front portion of the excavator 100 is lifted (hereinafter, referred to as the "front portion lifting action" for the sake of convenience), as opposed to the rear portion lifting action. In this case, the controller 30 may automatically control (correct) the operation of the attachment of the excavator 100 to reduce other types of unstable actions, other than the rear portion lifting action and the vibrating action. Further, the controller 30 may reduce the unstable action of the excavator 100 by maintaining the pressure in the bottom-side oil chamber of the boom cylinder 7 in a relatively low state using a control method (correction method) which will be described later, without determining whether or not the unstable action of the excavator is generated. In other words, the controller 30 may continue a bottom relief control that maintains the pressure of the bottom-side oil chamber of the boom cylinder 7 at the relatively low state, while monitoring the pressure of the bottom-side oil chamber of the boom cylinder 7, for example.

[Unstable Action of Excavator]

Next, the unstable action of the excavator 100, that becomes a target of the bottom relief control, will be described with reference to FIG. 3A through FIG. 5B.

<Overview of Unstable Action of Excavator>

FIG. 3A through FIG. 3F illustrate a specific example of a situation where the unstable action of the excavator 100, subject to the bottom relief control, is generated.

Figure 3A:
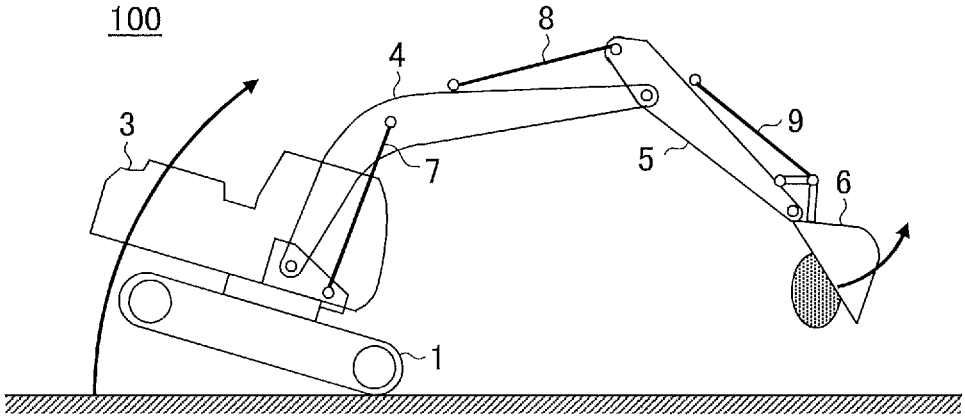
FIG. 3A is a diagram illustrating a specific example of a situation where an unstable action (rear portion lifting action and vibrating action) of the excavator, subject to a bottom relief control, is generated.
Figure 3B:
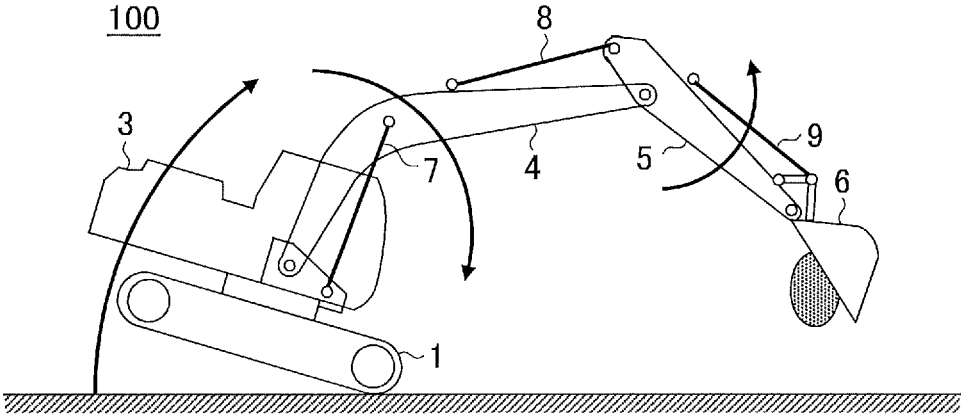
FIG. 3B is a diagram illustrating the specific example of the situation where the unstable action (rear portion lifting action and vibrating action) of the excavator, subject to the bottom relief control, is generated.

For example, FIG. 3A is a diagram schematically illustrating the situation where an earth-removing operation of the excavator 100 is performed by an opening operation of the bucket 6 (hereinafter referred to as a "bucket opening operation"). FIG. 3B is a diagram schematically illustrating the situation where the earth-removing operation of the excavator 100 is performed by a lowering operation of the boom 4 (hereinafter, referred to as a "boom lowering operation") and an opening operation of the arm 5 (hereinafter, referred to as an "arm opening operation").

As illustrated in FIG. 3A and FIG. 3B, when the bucket opening operation or the boom lowering operation and the arm opening operation are performed, the sediment or the like in the bucket 6 are unloaded to the outside, resulting in a change in a moment of inertia of the attachment of the excavator 100. As a result, the change in the moment of inertia may cause a moment in a pitching direction to act on the vehicle body, causing the vehicle body to roll frontward, and there is a possibility of generating the rear portion lifting action and the vibrating action in the excavator 100. In particular, in a case where clayey soil is loaded into the bucket 6, the clayey soil is not easily unloaded to the outside. For this reason, the operator or the like may perform an operation to intentionally vibrate the attachment. However, during such an operation, if the clayey soil becomes separated from the bucket 6 and is unloaded to the outside, this operation state may affect and cause the rear portion lifting action and the vibrating action of the excavator 100 to be promoted.

Figure 3C:
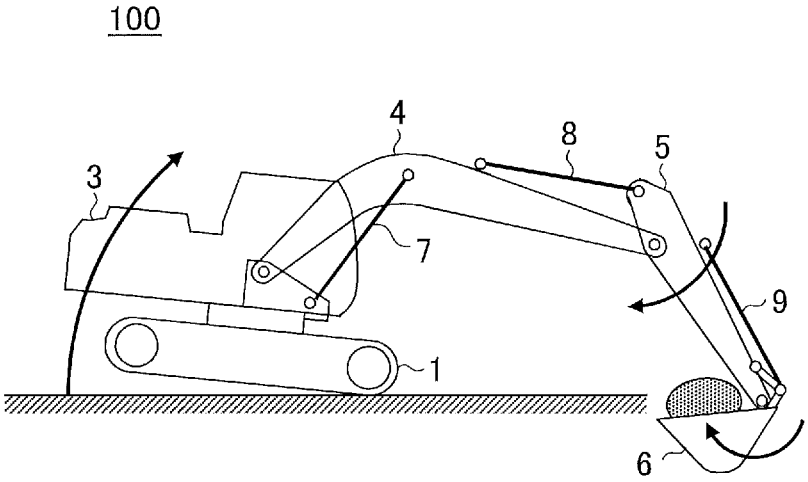
FIG. 3C is a diagram illustrating the specific example of the situation where the unstable action (rear portion lifting action and vibrating action) of the excavator, subject to the bottom relief control, is generated.

For example, FIG. 3C schematically illustrates the situation in a latter half of the excavation operation of the excavator 100 by a closing operation of the arm 5 and the bucket 6 (hereinafter respectively referred to as an "arm closing operation" and a "bucket closing operation"), and more particularly, the state of the operation in which the sediment or the like is caught by the bucket 6.

As illustrated in FIG. 3C, when an attempt is made to catch sediment or the like in the bucket 6 by the arm closing operation and the bucket closing operation, a reaction force from the ground or the sediment acts on the bucket 6. As a result, the reaction force, through the attachment, exerts a moment in the pitching direction which causes the vehicle body to roll frontward, and rear portion lifting and vibrating actions may be generated in the excavator 100.

Figure 3D:
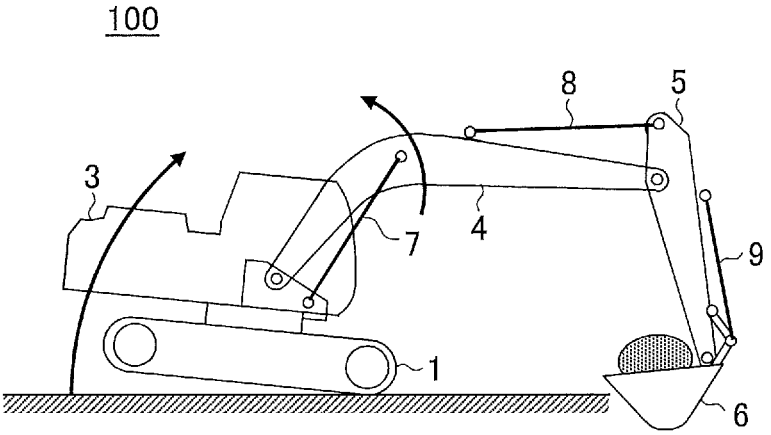
FIG. 3D is a diagram illustrating the specific example of the situation where the unstable action (rear portion lifting action and vibrating action) of the excavator, subject to the bottom relief control, is generated.

For example, FIG. 3D schematically illustrates the situation in the latter half of the excavation operation by a raising operation (hereinafter referred to as a "boom raising action") of the boom 4, and more particularly, the state of the operation in which the sediment or the like caught in the bucket 6 is lifted.

As illustrated in FIG. 3D, when the boom 4 is raised from the state where the bucket 6 is grounded, the load of the sediment or the like loaded into the bucket 6 acts additionally, and the moment of inertia of the attachment of the excavator 100 changes. As a result, the change in the moment of inertia may cause a moment in the pitching direction to act on the vehicle body, causing the vehicle body to roll frontward, and there is a possibility of generating the rear portion lifting action and the vibrating action in the excavator 100.

Figure 3E:
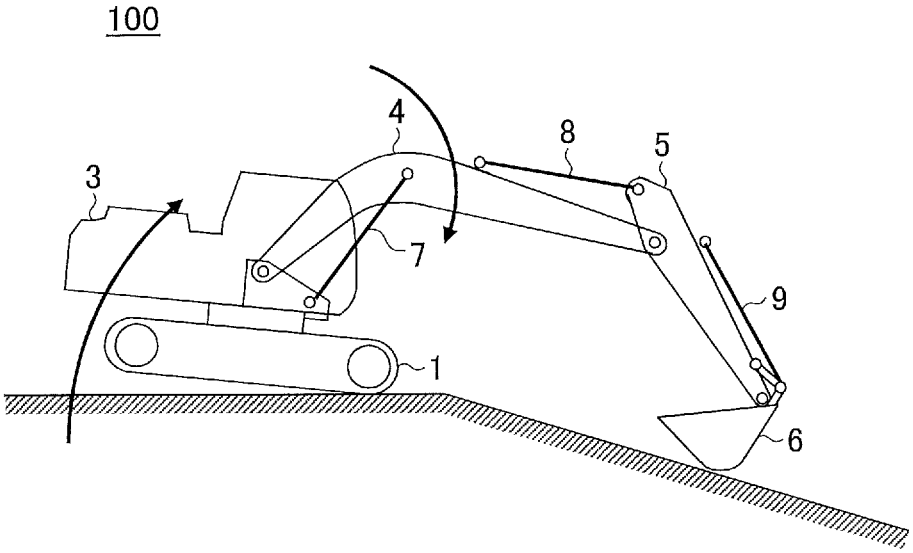
FIG. 3E is a diagram illustrating the specific example of the situation where the unstable action (rear portion lifting action and vibrating action) of the excavator, subject to the bottom relief control, is generated.

For example, FIG. 3E schematically illustrates the situation where the excavator 100 is suddenly stopped with the boom immediately above the ground after a sudden boom lowering operation, when starting the excavation operation.

As illustrated in FIG. 3E, when the boom lowering operation is stopped immediately after the sudden boom lowering operation, a reaction force caused by the sudden stop is applied to the vehicle body from the attachment. As a result, the reaction force from the attachment may cause a moment in the pitching direction to act on the vehicle body, causing the vehicle body to roll frontward, and there is a possibility of generating the rear portion lifting action and the vibrating action in the excavator 100.

Figure 3F:
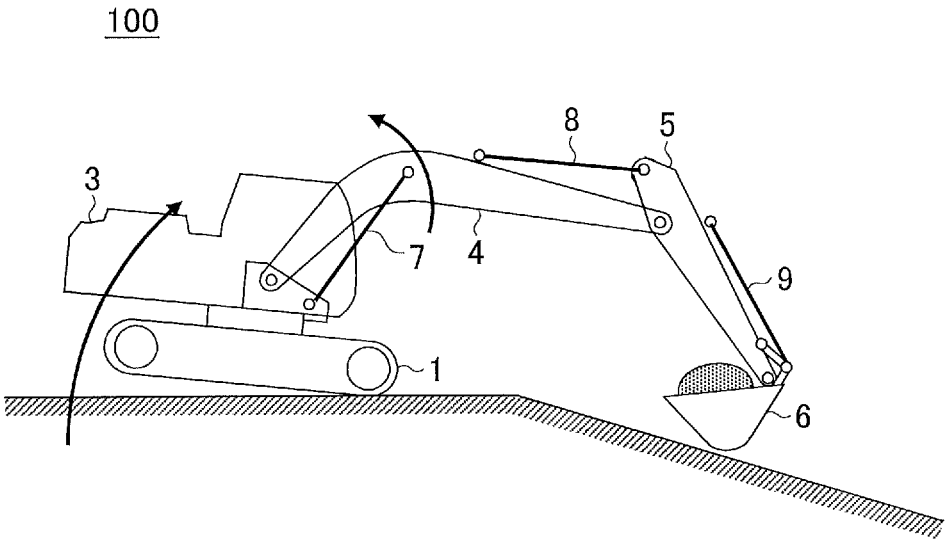
FIG. 3F is a diagram illustrating the specific example of the situation where the unstable action (rear portion lifting action and vibrating action) of the excavator, subject to the bottom relief control, is generated.

For example, FIG. 3F schematically illustrates the situation in the latter half of the excavation operation of the excavator 100 by the boom raising operation, more particularly, the situation where the sediment or the like caught in the bucket 6 is raised in a state where the bucket 6 is greatly separated relative to the vehicle body.

As illustrated in FIG. 3F, when the boom 4 is raised in the state where the bucket 6 is separated from the vehicle body, the change in the moment of inertia caused by the sediment or the like loaded into the bucket 6 becomes large relatively. As a result, this change in the moment of inertia may cause a moment in the pitching direction to act on the vehicle body, causing the vehicle body to roll frontward, and there is a possibility of generating the rear portion lifting action and the vibrating action in the excavator 100.

Further, there is a possibility of generating the rear portion lifting action and the vibrating action in the excavator 100 due to factors other than the operations in the situations illustrated in FIG. 3A through FIG. 3F.

For example, in a case where the connection between arm 5 and end attachment (bucket 6) is achieved by a quick coupling, a phase error may occur between the operation of the boom 4 and the arm 5 and the operation of end attachment. In this case, depending on the extent of a phase lag, a change may occur in the moment of inertia of the attachment, and this change in the moment of inertia may cause a moment in the pitching direction to act on the vehicle body, similar to the above described above cases, causing the vehicle body to roll frontward, and there is a possibility of generating the rear portion lifting action and the vibrating action in the excavator 100.

<Details of Rear Portion Lifting Action>

Figure 4:
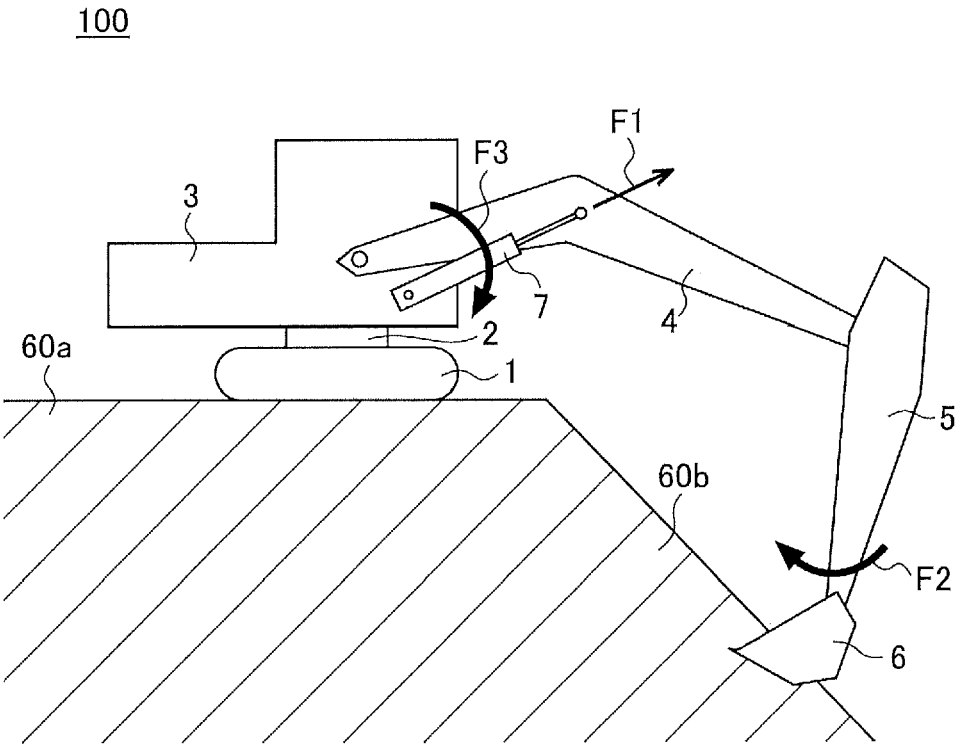
FIG. 4 is a diagram for explaining the rear portion lifting action of the excavator.

FIG. 4 is a diagram for explaining the rear portion lifting action of the excavator 100. More particularly, FIG. 4 is a diagram illustrating the operation state of an excavator 100 in which the rear portion lifting action is generated.

As illustrated in FIG. 4, the excavator 100 performs the excavation operation with respect to a ground 60*a*. A force F2 (moment) is generated so that the bucket 6 excavates a slope 60*b*, and a force F3 (moment) is generated so that the boom 4 presses the bucket 6 down on the slope 60*b*, that is, so that the boom 4 causes the vehicle body to tilt frontward. In this state, the force F1 is generated in the boom cylinder 7 to pull up the rod thereof, and the force F1 acts on the vehicle body of the excavator 100 to tilt frontward. Further, when the moment, due to the force F1, that cases the vehicle body to tilt frontward, exceeds a force (moment) that presses the vehicle body against the ground based on gravity, the rear portion of the vehicle body is lifted.

In particular, in cases where the bucket 6 is in contact with a target object such as the ground or the sediment or the like, and the bucket 6 is caught or is stuck in the target object, the rod position of the boom cylinder 7 does not change because the boom 4 does not move even when a force acts on the boom 4. Hence, when the pressure of the oil chamber on the contracting side (bottom side) of the boom cylinder 7 increases, the force F1 that raises the boom cylinder 7 itself, that is, the force that urges the vehicle body to tilt frontward, increases.

Similar situations may occur, as described above, in a deep excavation operation (refer to FIG. 3F) in which the bucket 6 is located below the vehicle body (undercarriage 1), in addition to the excavation operation with respect to the front slope illustrated in FIG. 4, for example. In addition, as described above, similar situations may occur not only in a case where the boom 4 itself is operated, but also in a case where the arm 5 or the bucket 6 is operated.

<Details of Vibrating Action>

Figure 5A:
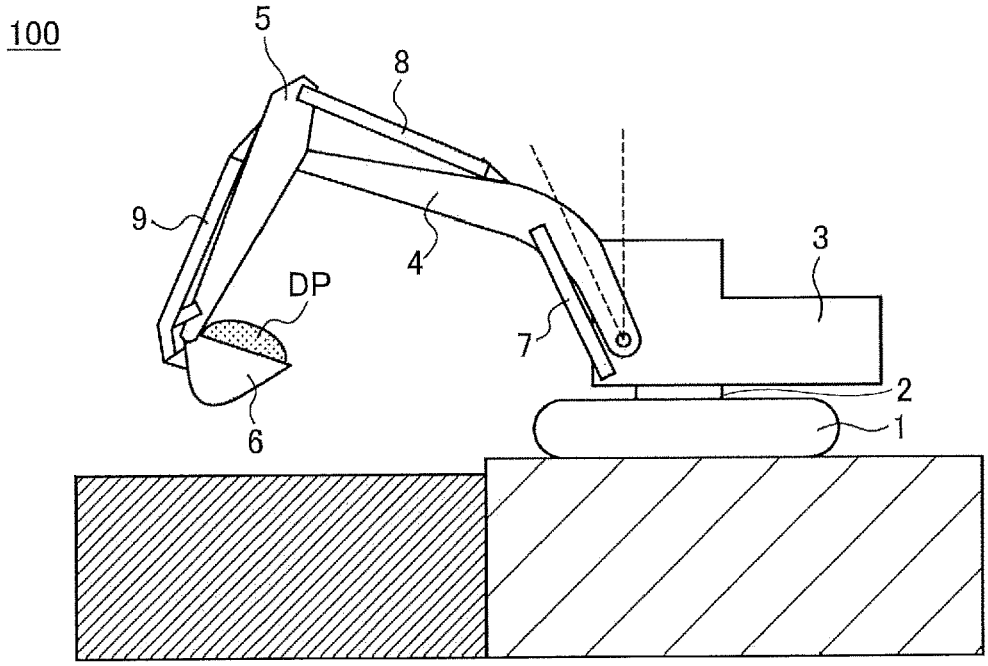
FIG. 5A is a diagram for explaining the vibrating action of the excavator.
Figure 5B:
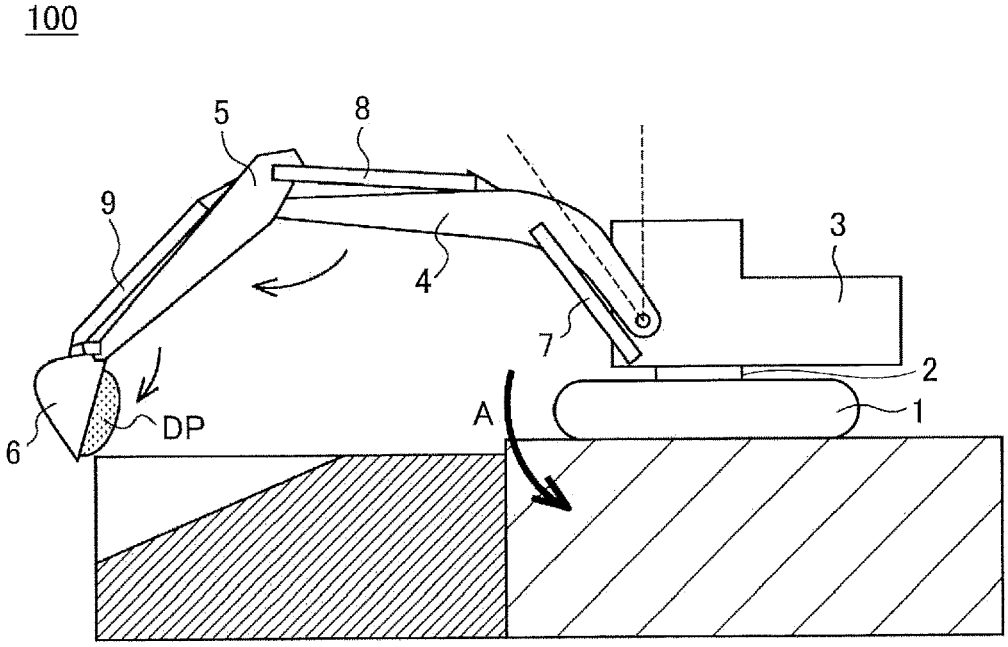
FIG. 5B is a diagram for explaining the vibrating action of the excavator.
Figure 6:
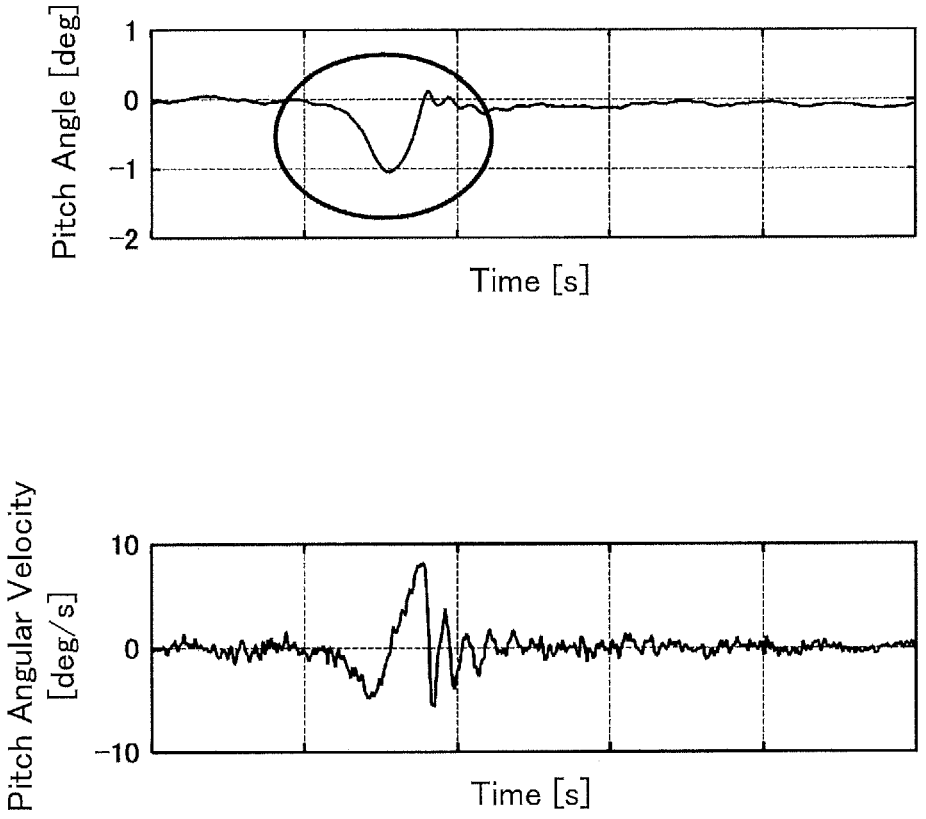
FIG. 6 is a diagram for explaining the vibrating action of the excavator.

FIG. 5A, FIG. 5B, and FIG. 6 are diagrams for explaining an example of the vibrating action of the excavator 100. More particularly, FIG. 5A and FIG. 5B are diagrams for explaining a situation where the vibrating action is generated during an in-air operation of the excavator 100. FIG. 6 is a diagram illustrating a time waveform of an angle (pitch angle) and an angular velocity (pitch angular velocity) in the pitch direction associated with an unloading operation of the excavator 100 in the situations illustrated in FIG. 5A and FIG. 5B. In this example, the unloading operation for unloading a load DP in the bucket 6 will be described as an example of the in-air operation.

As illustrated in FIG. 5A, the bucket 6 and the arm 5 are closed, and the boom 4 is in the raised state in the excavator 100, and the bucket 6 contains the load DP, such as the sediment or the like.

As illustrated in FIG. 5B, when the unloading operation is performed from the excavator 100 in the state illustrated in FIG. 5A, the bucket 6 and the arm 5 are opened wide, the boom 4 is lowered, and the load DP is unloaded outside the bucket 6. In this state, the change in the moment of inertia of the attachment acts to vibrate the vehicle body of the excavator 100 in the pitch direction indicated by an arrow A in FIG. 5B.

In this state, as illustrated in FIG. 6, an overturning moment urging the excavator 100 to overturn is generated due to the in-air operation, more particularly, the unloading operation (refer to an encircled portion in FIG. 6), and it may be seen that vibration is generated around a pitch axis. Further, when the vibrating action is generated in the excavator 100, the vibrating action may cause the front end lifting action, the rear end portion lifting action, or the like to be generated in the excavator 100, as described above.

[Method of Reducing Unstable Action of Excavator]

Next, a method of reducing the unstable action of the excavator 100 will be described with reference to FIG. 7 and FIG. 8A through FIG. 8C.

<Method of Reducing Lifting Action>

Figure 7:
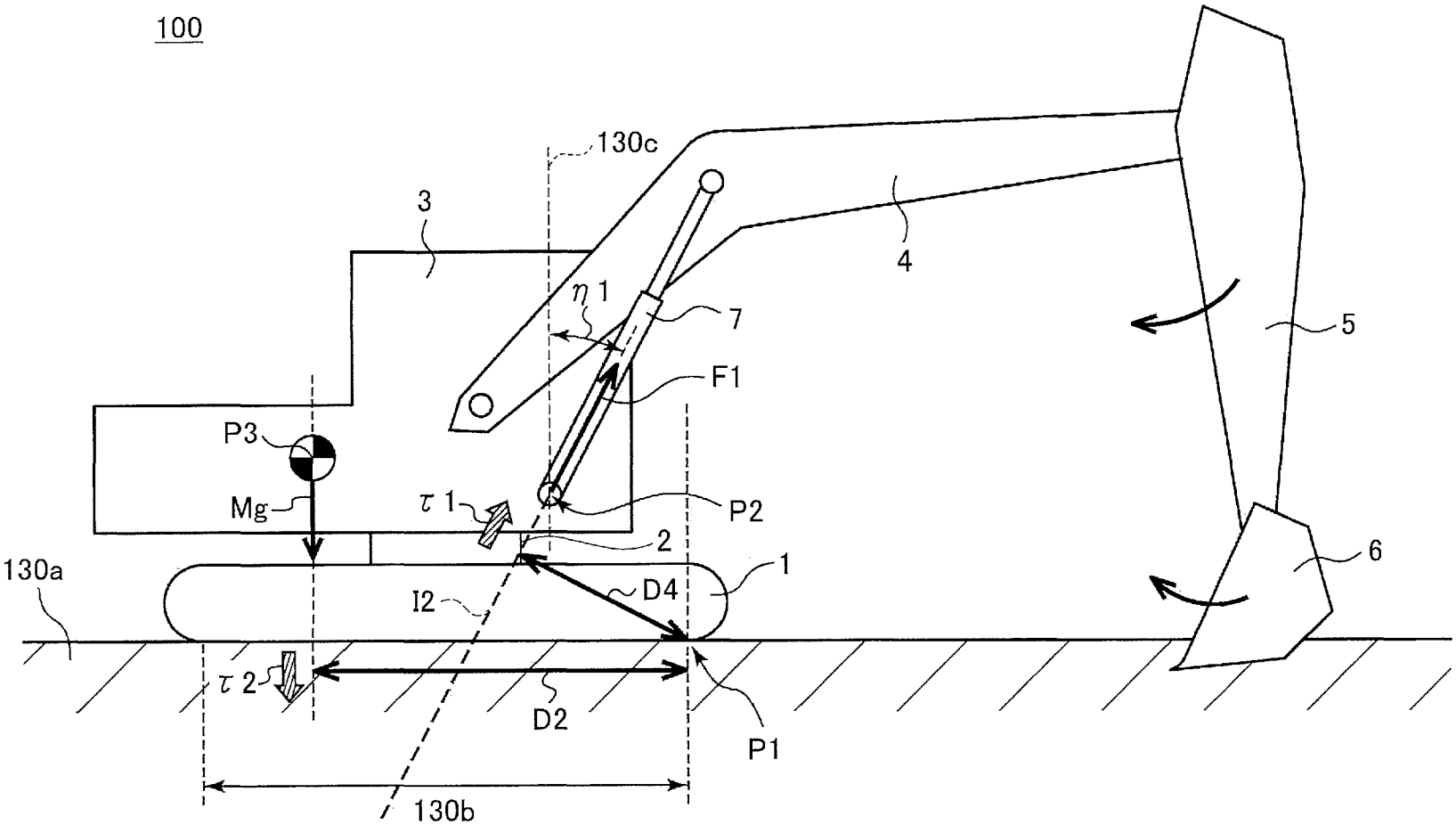
FIG. 7 is a diagram illustrating an example of a mechanical model associated with the rear portion lifting action.

FIG. 7 is a diagram illustrating a mechanical model of the excavator 100 associated with the rear portion lifting, and illustrating forces acting on the excavator 100 during the excavation operation with respect to the ground 130*a*.

An overturning fulcrum P1 in the rear portion lifting action of the excavator 100 may be regarded as a leading edge in the direction (the direction of the slewing upper structure 3) in which the attachment extends, in an effective grounding region 130*b* of the undercarriage 1. Hence, a moment τ1 urging the vehicle body to tilt around the overturning fulcrum P1, that is, the moment τ1 urging the lifting of the rear portion of the vehicle body, may expressed by the following formula (1), based on a distance D4 between an extension line 12 of the boom cylinder 7 and the overturning fulcrum P1, and the force F1 of the boom cylinder 7 affecting the slewing upper structure 3.

$$\tau 1 = D4 \cdot F1 \tag{1}$$

On the other hand, a moment τ2 pressing the vehicle body against the ground around the overturning fulcrum P1 by gravity is may be expressed by the following formula (2), based on a distance D2 between a center of vehicle body gravity P3 of the excavator and the overturning fulcrum P1 in front of the undercarriage 1, a vehicle body weight M, and a gravitational acceleration g.

$$\tau 2 = D2 \cdot Mg \tag{2}$$

A condition (stability condition) under which the rear portion of the vehicle body is not lifted and is stabile, may be expressed by the following formula (3).

$$\tau 1 < \tau 2 \tag{3}$$

Accordingly, the following inequality (4) may be obtained, as the stability condition, by substituting the formulas (1) and (2) into the formula (3).

$$D4 \cdot F1 < D2 \cdot Mg \quad (4)$$

In other words, the control section 302 can reduce the rear portion lifting action of the excavator 100, by correcting the operation of the attachment so that the inequality (4) is satisfied as the control condition.

For example, the force F1 may be expressed by a function f, using a rod pressure PR and a bottom pressure PB of the boom cylinder 7 as arguments, as indicated by the following formula (5).

$$F1 = f(PR, PB) \quad (5)$$

The control section 302 computes (estimates) the force F1 of the boom cylinder 7 affecting the slewing upper structure 3, based on the rod pressure PR and the bottom pressure PB. In this case, as described above, the control section 302 may acquire the rod pressure PR and the bottom pressure PB based on the output signals of the pressure sensors, that detect the rod pressure and bottom pressure of the boom cylinder 7 and may be included in the unstable action determination sensor 32.

As an example, the force F1 may be expressed by the following formula (6), using a rod-side pressure receiving area AR and a bottom-side pressure receiving area AB of the boom cylinder 7.

$$F1 = AB \cdot PB - AR \cdot PR \quad (6)$$

The control section 302 may compute (estimate) the force F1 based on the formula (6).

In addition, the control section 302 acquires the distances D2 and D4. The control section 302 may acquire a ratio (D1/D3 or D2/D4) of these distances.

The position of the vehicle body center of gravity P3, excluding attachment, is constant regardless of the swing angle θ of the slewing upper structure 3, but the position of the overturning fulcrum P1 varies according to the swing angle θ. For this reason, the control section 302 may compute the overturning fulcrum P1 based on the swing angle θ detected by a swing angle sensor or the like, for example, and compute the distance D2 based on a relative position relationship between the computed overturning fulcrum P1 and the vehicle body center of gravity P3. The distance D2 may vary depending on the swing angle θ of the slewing upper structure 3, but for the sake of simplicity, the distance D2 may be regarded as a constant. In this case, the control section 302 may acquire the pre-stored distance D2 from an internal memory of controller 30.

The distance D4 may be geometrically computed, based on the position of the overturning fulcrum P1, and the angle of the boom cylinder 7 (for example, an angle formed by the boom cylinder 7 and a vertical axis 130*c*).

The angle η1 may be geometrically computed from an extension length of the boom cylinder 7, dimensional data peculiar to the excavator 100, the inclination of the vehicle body of the excavator 100, or the like. For example, the control section 302 may compute an angle η1, using the output of the sensor, that detects the boom angle and may be included in the unstable action determination sensor 32. In addition, the angle may be acquired by utilizing an output of a sensor, that directly measures the angle η1 and may be included in the unstable action determination sensor 32.

The control section 302 controls the pressure of the boom cylinder 7, more particularly, the pressure of the bottom-side oil chamber in which the excessive pressure is built up, so that the inequality (4) holds, based on the force F1 acquired by computation or the like, and the distances D2 and D4. In other words, the control section 302 adjusts the bottom pressure PB of the boom cylinder 7 so that the inequality (4) holds. More particularly, by employing various configurations (refer to FIG. 9 through FIG. 11) described below, the control section 302 may adjust the pressure of the boom cylinder 7 by appropriately outputting the control command to the control target. Accordingly, by reducing the excessive pressure in the bottom-side oil chamber of the boom cylinder 7, the reduced pressure acts as a cushion when the vehicle body tilts as if to overturn frontward, and the rear portion lifting action of the excavator 100 can be reduced.

<Method of Reducing Vibrating Action>

Figure 8A:
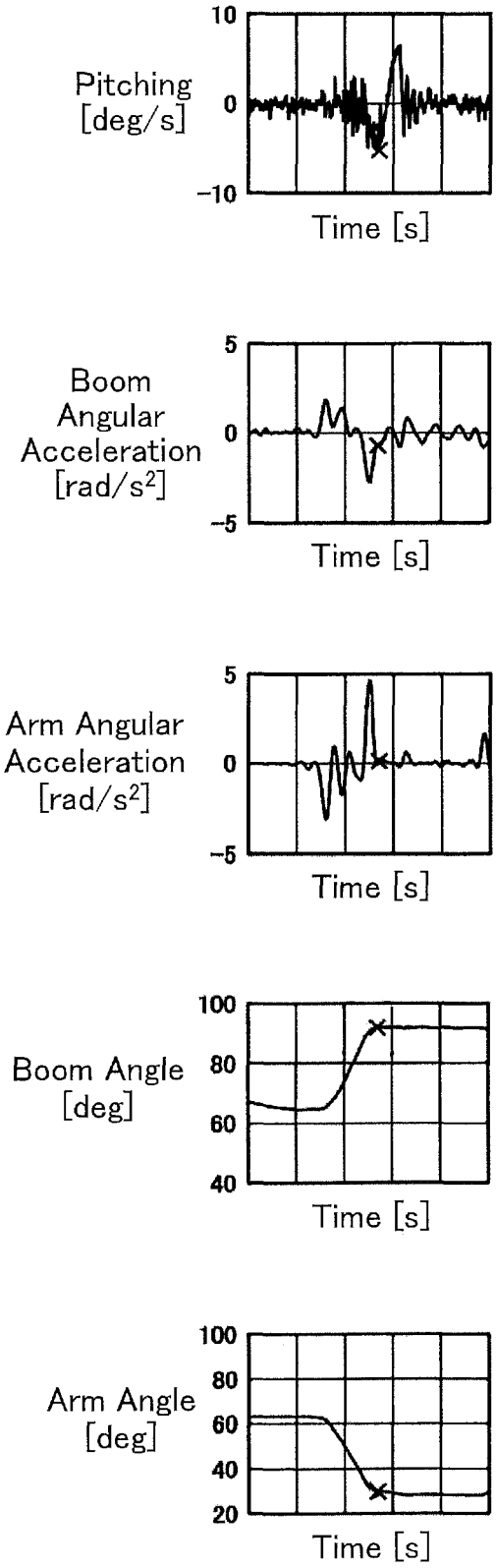
FIG. 8A is a diagram illustrating a specific example of an operation waveform chart associated with the vibrating action of the excavator.
Figure 8B:
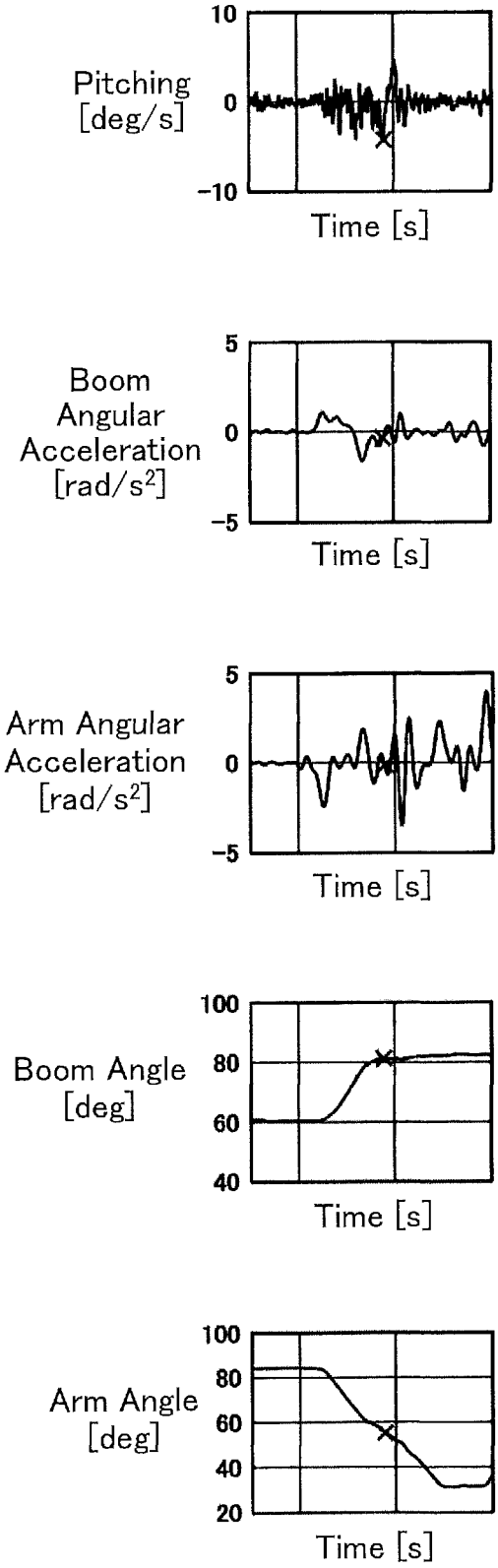
FIG. 8B is a diagram illustrating the specific example of the operation waveform chart associated with the vibrating action of the excavator.
Figure 8C:
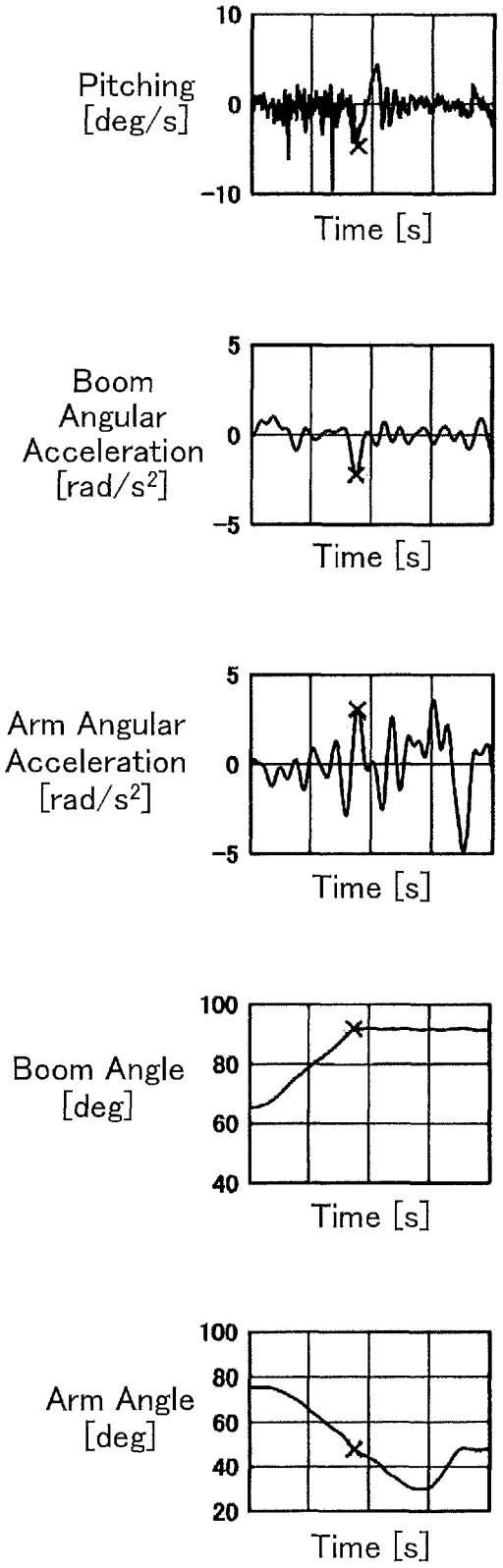
FIG. 8C is a diagram illustrating the specific example of the operation waveform chart associated with the vibrating action of the excavator.

FIG. 8A through FIG. 8C illustrate specific examples of the operating waveform associated with the vibrating action of the excavator 100. More particularly, FIG. 8A through FIG. 8C illustrate one example, another example, and still another example of the operation waveform chart for a case where the in-air operation is repeatedly performed in the excavator 100. FIG. 8A through FIG. 8C illustrate different trials, with the pitching angular velocity (that is, the vehicle body vibration), the boom angular acceleration, the arm angular acceleration, the boom angle, and the arm angle illustrated from the top to bottom.

In FIG. 8A through FIG. 8C, a symbol X indicates a point corresponding to a negative peak of the pitch angular velocity.

As illustrated in FIG. 8A through FIG. 8C, it may be seen that the vibrating action is induced when the change in the boom angle stops. In other words, the effect of the boom angular acceleration on the generation of the vibrating action may be regarded to be the largest, and this in turn indicates that controlling the boom angular velocity is effective in reducing the vibrating action. This may be understood intuitively because only the mass of the bucket 6 affects the moment of inertia related to the bucket angle, and while the mass of the bucket 6 and the arm 5 affects the moment of inertia related to the arm angle, the mass of not only the boom 4 but also the total mass of the arm 5 and the bucket 6 affect the moment of inertia related to the boom angle.

Accordingly, the control section 302 can correct the operation of the boom cylinder 7 by regarding the boom cylinder 7 as the control target. That is, the control section 302 can prevent a thrust of the boom cylinder 7 from exceeding an upper limit value based on the state of the attachment (that is, a limit thrust FMAX prescribed by the state of the attachment).

The thrust F of the boom cylinder 7 may be expressed by the following formula (7), based on the pressure receiving area AR of the rod-side chamber, the rod pressure PR of the rod oil chamber, the pressure receiving area AB of the bottom-side oil chamber, and the bottom pressure PB of the bottom-side oil chamber.

$$F = AB \cdot PB - AR \cdot PR \quad (7)$$

Accordingly, the thrust F of the boom cylinder 7 must be smaller than the limit thrust FMAX, and thus, the following formula (8) needs to stand.

$$FMAX > AB \cdot PB - AR \cdot PR \quad (8)$$

Hence, the following formula (9) can be obtained from the formula (8).

$$PB < (FMAX + AR \cdot PR)/AB \quad (9)$$

The right term of the formula (9) corresponds to an upper limit value PBMAX of the bottom pressure PB corresponding to the limit thrust FMAX, and the following formula (10) can be obtained.

$$PBMAX=(FMAX+AR\cdot PR)/AB \quad (10)$$

The control section 302 corrects the operation of the attachment, that is, the operation of the boom cylinder 7, so that the formula (10) stands. That is, the control section 302 adjusts (reduces) the bottom pressure PB of the boom cylinder 7 so that the formula (10) stands. More particularly, various configurations (refer to FIG. 9 through FIG. 11), which will be described later, may be employed so that the control section 302 adjusts (reduces) the bottom pressure PB of the boom cylinder 7 by appropriately outputting the control command to the control target. Hence, it is possible to reduce the vibrating action of the excavator 100.

The control section 302 acquires the limit thrust FMAX based on the detection signal from the unstable action determination sensor 32. More particularly, the control section 302 acquires the limit thrust FMAX by computations of the like using the state of the attachment, that is, the detection signal from the unstable action determination sensor 32, as an input. Accordingly, the control section 302 can compute the upper limit value PBMAX of the bottom pressure PB from the formula (10), and adjust the bottom pressure PB of the boom cylinder 7 so as not to exceed the computed upper limit value PBMAX.

In this state, when the limit thrust FMAX is set too small, lowering of the boom 4 occurs. For this reason, the control section 302 may acquire a thrust (holding thrust FMIN) capable of holding the attitude of the boom 4, and set the limit thrust FMAX in a range higher than the holding thrust FMIN.

For example, the control section 302 sets the limit thrust FMAX by matching the contents of the detection signal corresponding to the state of the attachment, with a map, table, or the like prestored in the internal memory of the controller 30 and having the contents of the detection signal as parameters.

[Configuration of Hydraulic Circuit Related to Bottom Relief Control]

Next, the configuration of the excavator 100 for reducing the unstable action, more particularly, the configuration centering on a hydraulic circuit related to a bottom relief control of the excavator 100, will be described with reference to FIG. 9 through FIG. 11.

Figure 9:
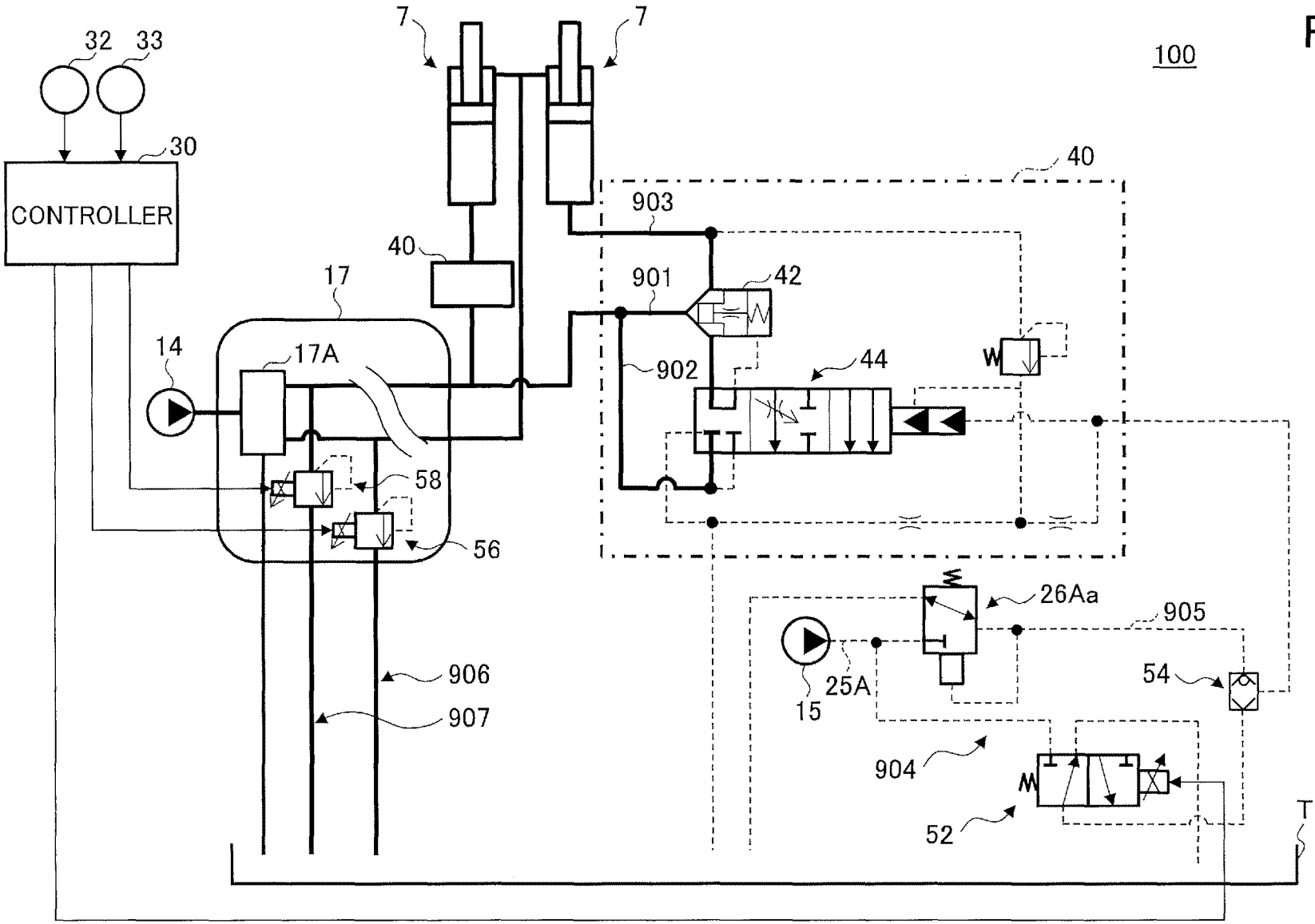
FIG. 9 is a diagram illustrating a first example of a configuration centering on a hydraulic circuit related to the bottom relief control of the excavator.

First, FIG. 9 is a diagram illustrating a first example of the configuration centering on the hydraulic circuit for supplying the hydraulic oil to the boom cylinder 7 of the excavator 100 according to this embodiment. In this example, two boom cylinders 7 are illustrated in FIG. 9, however, the control valve 17 and the hydraulic oil holding circuit 40 are interposed between the main pump 14 and the boom cylinder 7, and the same applies to each boom cylinder 7. For this reason, the hydraulic circuit for one of the boom cylinders 7 (the boom cylinder 7 on the right in FIG. 9) will be mainly described. In the following, the same also applies to FIG. 10 and FIG. 11.

As illustrated in FIG. 9, the excavator 100 in this example is provided with the hydraulic oil holding circuit 40 for holding the hydraulic oil so as not to be discharged from the bottom-side oil chamber of the boom cylinder 7, even when the hose of the high-pressure hydraulic oil line is damaged by a rupture or the like, as described above.

The hydraulic oil holding circuit 40 is provided in the high-pressure hydraulic line (oil passage) connecting the control valve 17 and the bottom-side oil chamber of the boom cylinder 7. The hydraulic oil holding circuit 40 mainly includes a holding valve 42 and a spool valve 44.

The holding valve 42 tolerates the flow of the hydraulic oil from the control valve 17 to the bottom-side oil chamber of the boom cylinder 7. More particularly, the holding valve 42 supplies the hydraulic oil, supplied from the control valve 17 through the oil passage 901, to the bottom-side oil chamber of the boom cylinder 7 through the oil passage 903, in correspondence with the boom raising operation with respect to the operating device 26 to raise the boom 4. On the other hand, the holding valve 42 blocks the discharge of the hydraulic oil from the bottom-side oil chamber of the boom cylinder 7 (oil passage 903) to the oil passage 901 connected to the control valve 17. The holding valve 42 is a poppet valve, for example.

In addition, the holding valve 42 is connected to one end of the oil passage 902 that branches from the oil passage 901, and is capable of discharging the hydraulic oil from the bottom-side oil chamber of the boom cylinder 7 into the oil passage 901 (control valve 17) on the downstream side, through the spool valve 44 arranged in the oil passage 902. More particularly, in a case where the spool valve 44 provided in the oil passage 902 is in a non-communicating state (a left end spool position in FIG. 9), the holding valve 42 holds the hydraulic oil so as not to be discharged from the bottom-side oil chamber of the boom cylinder 7 to the downstream side of the hydraulic oil holding circuit 40 (oil passage 901). On the other hand, in a case where the spool valve 44 is in a communicating state (a center or right end spool position in FIG. 9), the holding valve 42 can discharge the hydraulic oil from the bottom-side oil chamber of the boom cylinder 7 to the downstream side of the hydraulic oil holding circuit 40, through the oil passage 902.

The spool valve 44 (one example of a first discharge valve) is provided in the oil passage 902, and can bypass and discharge the hydraulic oil in the bottom-side oil chamber of the boom cylinder 7 that is shut off by the holding valve 42, to the downstream side of the hydraulic oil holding circuit 40 (oil passage 901). The spool valve 44 has a first spool position (left end spool position in FIG. 9) to put the oil passage 902 in the non-communicating state, a second spool position (center spool position in FIG. 9) to put the oil passage 902 in the communicating state by restricting, and a third spool position (right end spool position in FIG. 9) to put the oil passage 902 in the communicating state by fully opening. In this state, at the second spool position, the spool valve 44 varies the degree of restriction according to the magnitude of the pilot pressure input to a pilot port.

In a case where the pilot pressure is not input to the pilot port, the spool valve 44 is in the first spool position, and the hydraulic oil in the bottom-side oil chamber of the boom cylinder 7 is not discharged to the downstream side (oil passage 901) of the hydraulic oil holding circuit 40 through the oil passage 902. On the other hand, in a case where the pilot pressure is input to the pilot port, the spool valve 44 is at either the second spool position or the third spool position, according to the magnitude of the pilot pressure. More particularly, the degree of restriction at the second spool position of the spool valve 44 decreases as the pilot pressure acting on the pilot port increases, and the spool approaches the third spool position from the second spool position. In addition, the spool of the spool valve 44 reaches the third spool position when the pilot pressure acting on the pilot port becomes large to a certain extent.

In this example, a pilot circuit is provided to input the pilot pressure to the spool valve 44. This pilot circuit includes the pilot pump 15, a boom lowering remote control valve 26Aa, a solenoid proportional valve 52, and a shuttle valve 54.

The boom lowering remote control valve 26Aa is connected to the pilot pump 15 through a pilot line 25A. The boom lowering remote control valve 26Aa is included in the lever device 26A which operates the boom lowering cylinder 7, and outputs a pilot pressure corresponding to the boom lowering operation using a primary side pilot pressure supplied from the pilot pump 15 as a main pressure.

The solenoid proportional valve 52 branches from the pilot line 25A between the pilot pump 15 and the boom lowering remote control valve 25A1, and is provided in an oil passage 904 that connects to one port of the shuttle valve 54 by bypassing the boom lowering remote control valve 25Aa. The solenoid proportional valve 52 switches the oil path 904 between communicating and non-communicating states, according to the presence or absence of a control current input from the controller 30. In addition, the solenoid proportional valve 52 also controls the magnitude of a secondary side pilot pressure output to the shuttle valve 54, according to the magnitude of the control current input from the controller 30, by using the primary side pilot pressure supplied from the pilot pump 15 as the main pressure. For example, the solenoid proportional valve 52 increases the secondary side pilot pressure output to the shuttle valve 54 as the magnitude of the control current input from the controller 30 increases.

One input port of the shuttle valve 54 is connected to one end of oil passage 904, and another input port of the shuttle valve 54 is connected to an oil passage 905 on the secondary side of the boom lowering remote control valve 25Aa. The shuttle valve 54 outputs the higher pilot pressure of the two input ports to the pilot port of spool valve 44. As a result, at least in a case where the boom lowering operation is performed with respect to the lever device 26A, the pilot pressure from the shuttle valve 54 acts on the pilot port of the spool valve 44, and the spool valve 44 assumes the communicating state. For this reason, the spool valve 44 can discharge the hydraulic oil from the bottom-side oil chamber of the boom cylinder 7 to the downstream side (oil passage 901) of the hydraulic oil holding circuit 40 through the oil passage 902, in correspondence with the boom lowering operation with respect to the lever device 26A. In other words, the spool valve 44 is linked to the operation state of the lever device 26A, to discharge the hydraulic oil blocked by the holding valve 42 from the bottom-side oil chamber of the boom cylinder 7 in the case where the boom lowering operation is performed with respect to the lever device 26A. Moreover, even in a case where the boom lowering operation is not performed with respect to the lever device 26A, the shuttle valve 54 can apply the pilot pressure to the pilot port of the spool valve 44 from the solenoid proportional valve 52 through the shuttle valve 54, under the control of the controller 30. Hence, the controller 30 can cancel the hydraulic oil holding function of the hydraulic oil holding circuit 40 (spool valve 44) through the solenoid proportional valve 52, and put the oil passage 902 into the communicating state regardless of whether or not the boom lowering operation is performed with respect to the lever device 26A, to discharge the hydraulic oil in the bottom-side oil chamber of the boom cylinder 7 to the downstream side (oil passage 901) of the hydraulic oil holding circuit 40. In other words, the controller 30 can discharge the hydraulic oil from the bottom-side oil chamber of the boom cylinder 7, regardless of the operation state of the lever device 26A, by canceling the hydraulic oil holding function of the hydraulic oil holding circuit 40 by controlling the spool valve 44, in a state where the link between the spool valve 44 and the operation state of the lever device 26A is temporarily canceled, according to the state of the excavator 100 (more particularly, whether or not the unstable action is generated, or whether or not there is a possibility that the unstable action is generated).

Moreover, in this example, solenoid relief valves 56 and 58 are provided inside the control valve 17.

The solenoid relief valve 56 is provided in an oil passage 906 that branches from an oil passage between the rod-side oil chamber of the boom cylinder 7, and the directional control valve 17A for the boom provided inside the control valve 17, and the oil passage 906 is connected to a tank T. Accordingly, the solenoid relief valve 56 can discharge the hydraulic oil in the rod-side oil chamber of the boom cylinder 7 to the tank T, according to the control current input from the controller 30.

The location of the solenoid relief valve 56 is not particularly limited, as long as the hydraulic oil can be discharged to the tank T from the oil passage between the rod-side oil chamber of the boom cylinder 7 and the directional control valve 17A for the boom. For example, the solenoid relief valve 56 may be provided outside the control valve 17.

The solenoid relief valve 58 is provided in an oil passage 907 that branches from an oil passage (an oil passage inside the control valve 17, extending from the oil passage 901) between the hydraulic oil holding circuit 40, and the directional control valve 17A for the boom provided inside the control valve 17, and the oil passage 907 is connected to the tank T. Thus, the solenoid relief valve 58 can discharge the hydraulic oil flowing out of the bottom-side oil chamber of the boom cylinder 7 to the tank T, through the hydraulic oil holding circuit 40 (spool valve 44 and oil passage 902), according to the control current input from the controller 30.

The location of the solenoid relief valve 58 is not particularly limited, as long as the hydraulic oil can be discharged to the tank T from the oil passage between the hydraulic oil holding circuit 40 and the directional control valve 17A for the boom. For example, the solenoid relieve valve 58 may be provided outside the control valve 17.

In this example, a boom acting velocity measuring sensor 33 is provided.

The boom acting velocity measuring sensor 33 outputs detection information related to an acting velocity in an up-and-down direction (hereinafter, referred to as a "vertical acting velocity") of the boom 4. The boom acting velocity measuring sensor 33 may directly output the detection information corresponding to the vertical acting velocity of the boom 4, or may output the detection information required to compute the vertical acting velocity of the boom 4. The boom acting velocity measuring sensor 33 may include at least one of a cylinder sensor for detecting the position, velocity, or acceleration of a piston (rod) of the boom cylinder 7, an angle sensor for detecting the pitch angle (boom angle) of the boom 4, and a sensor (for example, an acceleration sensor and an angular velocity sensor, a 6-axis sensor, an IMU) for detecting the acceleration and angular velocity of the boom 4, or the like, for example. The detection information from the boom acting velocity measurement sensor 33 is input to the controller 30.

As described above, the controller 30 (determination section 301) determines whether or not unstable action of the excavator 100 is generated, or whether or not there is a possibility that the unstable action is generated, based on the detection information input from the unstable action determination sensor 32. When the controller 30 (determination section 301) determines that the unstable action (rear portion lifting action or vibrating action) is generated, or there is a possibility that the unstable action is generated, the controller 30 (the control section 302) outputs a control current to the solenoid proportional valve 52 and the solenoid relief valve 58, to cancel the hydraulic oil holding function of the hydraulic oil holding circuit 40, thereby performing the bottom relief control. Thus, regardless of whether or not the boom lowering operation is performed, the controller 30 can cause the hydraulic oil in the bottom-side oil chamber of the boom cylinder 7 to flow out through the hydraulic oil holding circuit 40, and discharge the hydraulic oil from the solenoid relief valve 58 to the tank T. For this reason, the controller 30 can adjust (reduce) the excessive pressure in the bottom-side oil chamber of the boom cylinder 7, and reduce the unstable action of the excavator 100, as described above.

In the case where the controller 30 outputs the control current to the solenoid proportional valve 52, the controller 30 limits the flow rate of the hydraulic oil passing through the spool valve 44, so that a displacement of the boom cylinder 7 in the lowering direction within a predetermined time (that is, an average acting velocity) becomes less than or equal to a predetermined threshold value. In other words, the controller 30 restrictively cancels the hydraulic oil holding function of the hydraulic oil holding circuit 40, by outputting to the solenoid proportional valve 52 a control current in a range such that the displacement of the boom cylinder 7 in the lowering direction within the predetermined time becomes less than or equal to the predetermined threshold value. For example, the controller 30 successively acquires the acting velocity of the boom 4 in the lowering direction based on the detection information from the boom acting velocity measurement sensor 33. In addition, the controller 30 determines the control current to be output to the solenoid proportional valve 52, using a known control method such as a feedback control or the like, while monitoring the acting velocity of the boom 4 in the lowering direction that is successively acquired. Thus, even when a hose burst occurs in the high-pressure hydraulic line on the downstream side of the hydraulic oil holding circuit 40, during the bottom relief control by the controller 30, for example, it is possible to reduce the drop of the boom 4 because the flow rate of the spool valve 44 is limited. More particularly, it is possible to reduce the drop of the boom 4 in a situation where the drop of the boom 4 may occur, among the operation states of the excavator 100 in FIG. 3A through FIG. 3F subject to the bottom relief control described above, that is, in a situation (FIG. 3A and FIG. 3C) where the lever device 26A is in the neutral state with regard to the operation of the boom 4, or in a situation (FIG. 3B and FIG. 3E) where the boom lowering operation is performed. In other words, the controller 30 can simultaneously prevent dropping of the boom 4 when the hose burst occurs, and reduce the unstable action of the excavator 100, by discharging the hydraulic oil of the boom cylinder 7 flowing out through the hydraulic oil holding circuit 40, from the solenoid relief valve 58 to the tank T, while limiting the flow rate of the spool valve 44.

Figure 10:
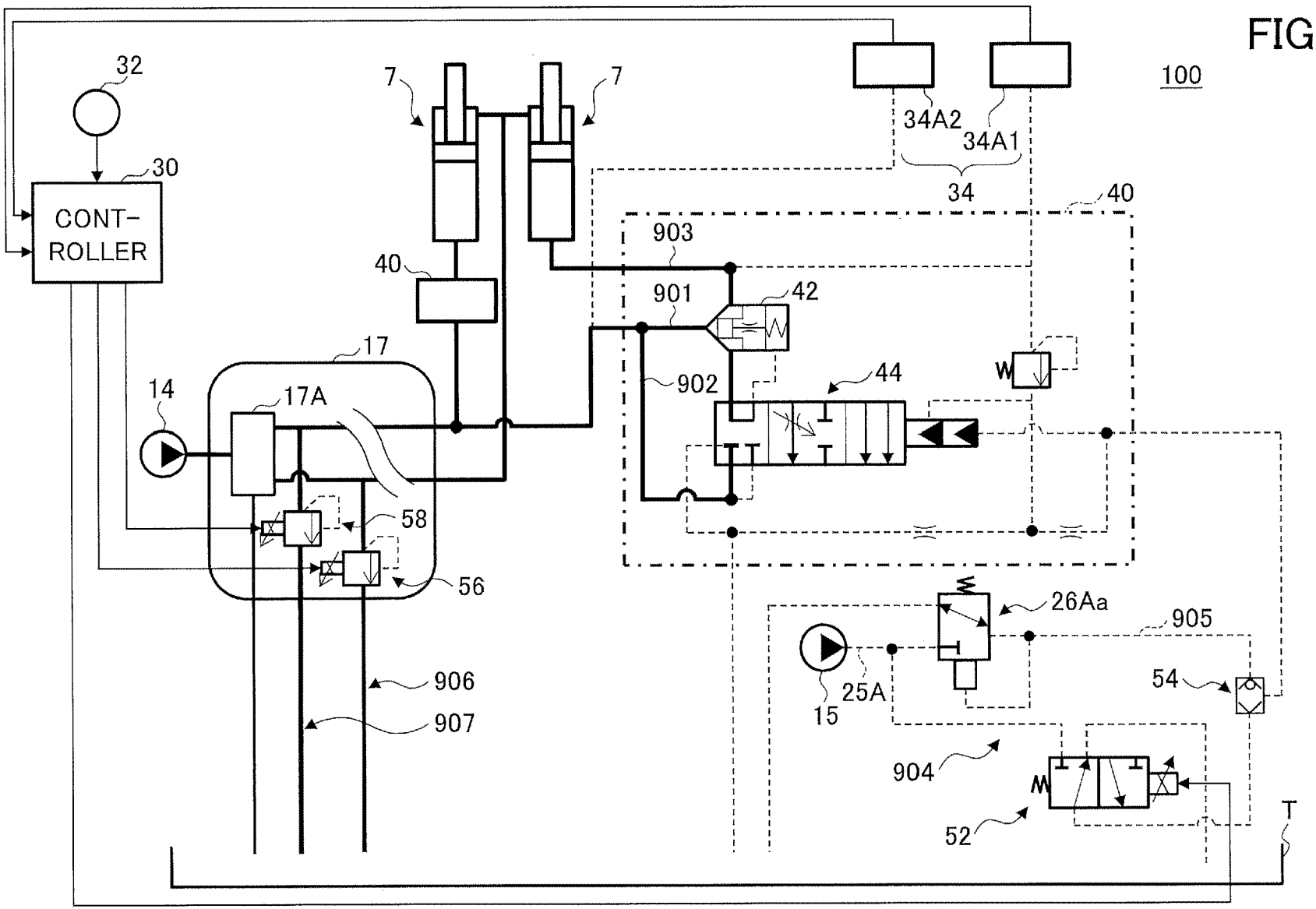
FIG. 10 is a diagram illustrating a second example of the configuration centering on the hydraulic circuit related to the bottom relief control of the excavator.

Next, FIG. 10 is a diagram illustrating a second example of the configuration centering on the hydraulic circuit for supplying the hydraulic oil to the boom cylinder 7 of the excavator 100 according to this embodiment. In this example, a description is centered on portions that are different from those of the first example illustrated in FIG. 9, and a repeated description of the same portions will be omitted.

In this example, a hose burst determination sensor 34 is provided in place of the boom acting velocity measurement sensor 33.

The hose burst determination sensor 34 outputs detection information for determining whether a hose burst occurred in the high-pressure hydraulic line on the downstream side of the hydraulic oil holding circuit 40. In this example, the hose burst determination sensor 34 includes pressure sensors 34A1 and 34A2 (examples of first and second pressure sensors, respectively) for detecting the pressure of the hydraulic oil on the upstream side (oil passage 903 on the side of the boom cylinder 7) of the hydraulic oil holding circuit 40 (holding valve 42), and the pressure of the hydraulic oil on the downstream side (oil passage 901 on the side of the control valve 17), respectively. Hence, the hose burst determination sensor 34 can directly detect the presence or absence of the hose burst. The detection information from the hose burst determination sensor 34 is input to the controller 30.

Instead of directly detecting the presence or absence of the hose burst, the hose burst determination sensor 34 may output detection information that can indirectly determine the presence or absence of the hose burst. For example, the hose burst determination sensor 34 may detect the operation of the excavator 100 associate with the hose burst, that is, the operation of the excavator 100 that may change when the hose burst occurs. More particularly, the hose burst determination sensor 34 may include an inertial sensor (an acceleration sensor, an angular velocity sensor, a 6-axis sensor, an IMU, or the like) for detecting at least one of the acceleration and the angular velocity of the boom 4. In addition, the hose burst determination sensor 34 may include a cylinder sensor for detecting at least one of a piston position, a velocity, and an acceleration of the boom cylinder 7. Moreover, the hose burst determination sensor 34 may include an angle sensor for detecting the pitch angle (boom angle) of the boom 4. Furthermore, the hose burst determination sensor 34 may include a plurality of such sensors. Accordingly, the controller 30 can grasp the operation state of the boom 4 in the operating device 26, and the actual operation state of the boom 4, and determine whether or not the hose burst occurred, based on the presence or absence of the dropping of the boom 4 corresponding to the hose burst.

As described above, the controller 30 determines whether or not the unstable action of the excavator 100 is generated, or whether or not there is a possibility that the unstable action is generated, based on the detection information input from the unstable action determination sensor 32. When the controller 30 (control section 302) determines that the unstable action (rear portion lifting action or vibrating action) is generated, or there is a possibility that the unstable action is generated, the controller 30 (the control section 302) outputs the control current to the solenoid proportional valve 52 and the solenoid relief valve 58, to cancel the hydraulic oil holding function of the hydraulic oil holding circuit 40, and perform the bottom relief control. In this state, the controller 30 performs the bottom relief control by outputting to the solenoid proportional valve 52 the control current that controls the spool of the spool valve 44 to the third spool position, that is, fully opens the oil passage 902, thereby completely canceling the hydraulic oil holding function of the hydraulic oil holding circuit 40. Accordingly, the restriction by the oil passage 902 on the flow rate of the hydraulic oil flowing out of the boom cylinder 7 is relaxed, and it is possible to increase a pressure adjustment range of the pressure in the bottom-side oil chamber of the boom cylinder 7 by the solenoid relief valve 58. For this reason, the controller 30 can more appropriately adjust (reduce) the excessive pressure in the bottom-side oil chamber of the boom cylinder 7, and further reduce the unstable action of the excavator 100.

In addition, the controller 30 determines the presence or absence of the hose burst during the bottom relief control, based on the detection information from the hose burst determination sensor 34. In this example, the controller 30 determines the existence or absence of the hose burst, based on a pressure difference between the respective detection values of the pressure sensors 34A1 and 34A2. When the controller 30 determines that the hose burst occurred, the controller 30 stops the bottom relief control, by stopping the output of the control current to the solenoid proportional valve 52 and the solenoid relief valve 58, to stop the canceling of the hydraulic oil holding function of the hydraulic oil holding circuit 40, that is, to restore the hydraulic oil holding function. Accordingly, the controller 30 can simultaneously prevent the dropping of the boom 4 when the hose burst occurs, and reduce the unstable action of the excavator 100.

The controller 30 may output to the solenoid proportional valve 52 a control current that slightly restricts the oil passage 902 by the spool valve 44, that is, the control current that controls the spool valve 44 to the second spool position. Hence, when hose burst occurs, a pressure difference is more easily generated between the detection values of the pressure sensors 34A1 and 34A2, and the controller 30 can more appropriately determine the presence or absence of the hose burst. In this case, the degree of restriction at the second spool position of the spool valve 44 is extremely small, but to an extent such that the pressure difference is generated between the pressure sensors 34A1 and 34A2 when the hose burst occurs. In other words, unlike the first example illustrated in FIG. 9, the flow rate of the hydraulic oil passing through the oil passage 902 is almost unrestricted. That is, the controller 30 restrictively cancels the hydraulic oil holding function of the hydraulic oil holding circuit 40 with an extremely low degree of restriction, to perform the bottom relief control. Moreover, in the case where the controller 30 determines that the hose burst occurred, the controller 30 may restrict the bottom relief control instead of stopping the bottom relief control. More particularly, in the case where the controller 30 determines that the hose burst occurred, the controller 30 may continue the bottom relief control while outputting to the solenoid control valve 52 the control current in the range such that the displacement of the boom cylinder 7 in the lowering direction within the predetermined time becomes less than or equal to the predetermined threshold value, similar to the first example illustrated in FIG. 9. In other words, in the case where the controller 30 determines that the hose burst occurred, the controller 30 may restrict the canceling of the hydraulic oil holding function of the hydraulic oil holding circuit 40, instead of stopping the hydraulic oil holding function. Alternatively, in this example, a solenoid switching valve, that switches the state of the oil passage 904 between the communicating state and the non-communicating state, may be provided in place of the solenoid proportional valve 52: This is because, in this example, unlike the first example illustrated in FIG. 9, there is no need to restrict the pilot pressure acting on the pilot port of the spool valve 44.

Figure 11:
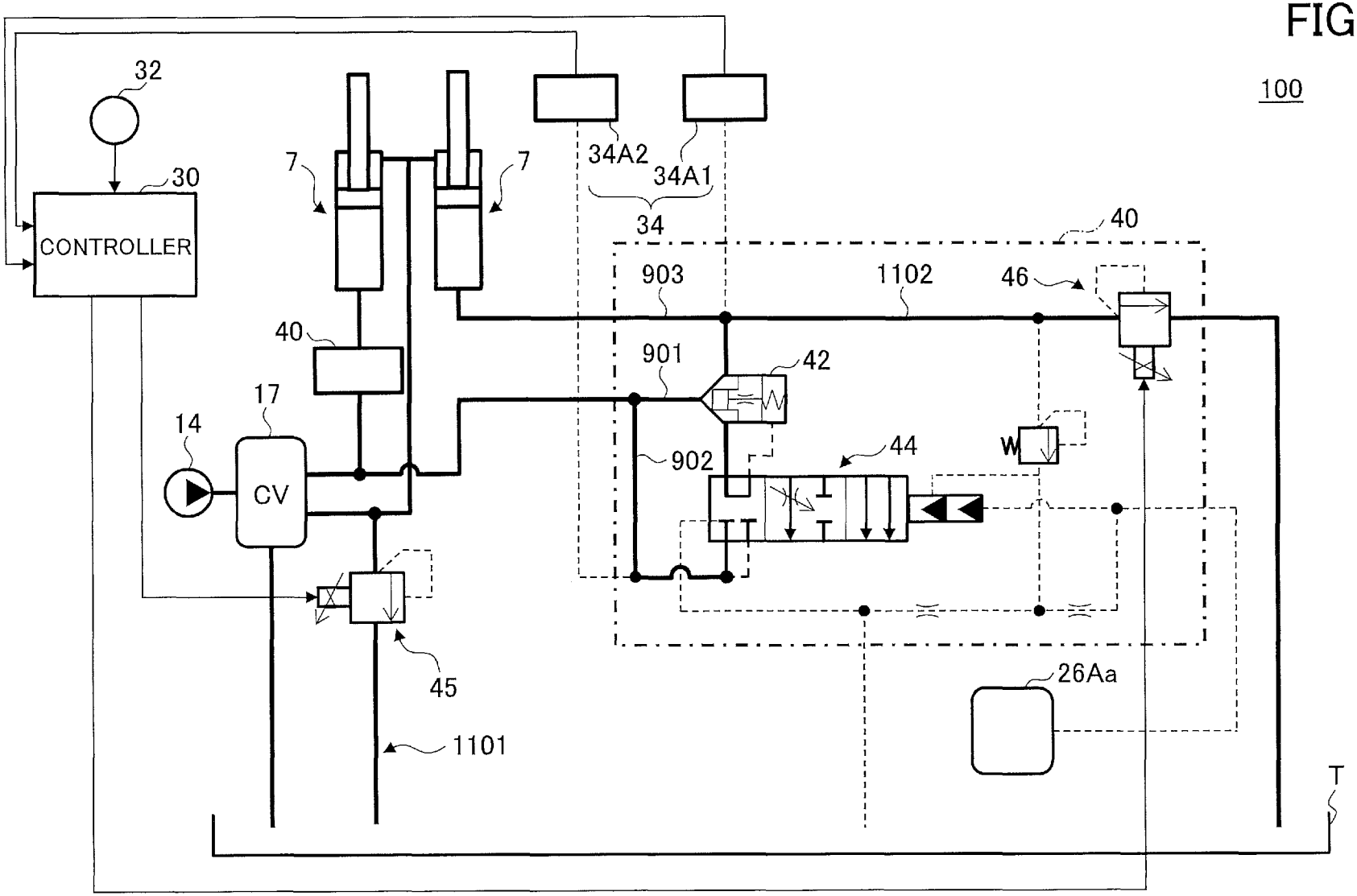
FIG. 11 is a diagram illustrating a third example of the configuration centering on the hydraulic circuit related to the bottom relief control of the excavator.

Next, FIG. 11 is a diagram illustrating a third example of the configuration centering on the hydraulic circuit for supplying the hydraulic oil to the boom cylinder 7 of the excavator 100 according to this embodiment. In this example, a description is centered on portions that are different from those of the first example illustrated in FIG. 9, and a repeated description of the same portions will be omitted.

In this example, the shuttle valve 54 and the solenoid proportional valve 52 are omitted, and the pilot pressure on the secondary side of the boom lowering remote control valve 26Aa acts on the pilot port of the spool valve 44. In other words, the spool valve 44 is linked to the operation state of the lever device 26A, and assumes the second spool position or the third spool position only in the case where the boom lowering operation is performed with respect to the lever device 26A, thereby putting the oil passage 902 in the communicating state. Accordingly, in the case where the boom lowering operation is not performed with respect to the lever device 26A, the oil passage 902 is put in the non-communicating state, and the flow of the hydraulic oil from the boom cylinder 7 is blocked.

Further, in this example, solenoid relief valves 45 and 46 are provided outside the control valve 17, in place of the solenoid relief valves 56 and 58 inside the control valve 17.

The solenoid relief valve 45 branches from the oil passage between the rod-side oil chamber of the boom cylinder 7 and the control valve 17, and is provided in an oil passage 1101 connected to the tank T. Hence, the solenoid relief valve 45 can discharge the hydraulic oil from the rod-side oil chamber of the boom cylinder 7 to the tank T, according to the control current input from the controller 30.

The location of the solenoid relief valve 45 is not particularly limited, as long as the hydraulic oil can be discharged to the tank T from the oil passage between the rod-side oil chamber of the boom cylinder 7 and the directional control valve 17A. In other words, similar to the example illustrated in FIG. 9, the solenoid relief valve 56 may be provided inside the control valve 17, in place of the solenoid relief valve 45.

The solenoid relief valve 46 (a second example of the discharge valve) branches from the oil passage 903 between the holding valve 42 inside the hydraulic oil holding circuit 40 and the bottom-side oil chamber of the boom cylinder 7, and is provided in an oil passage 1102 connected to the tank T. In other words, the solenoid relief valve 46 relieves the hydraulic oil to the tank T from the upstream side of the holding valve, that is, the oil passage 903 on the side of the boom cylinder 7, according to the control current input from the controller 30. Accordingly, the solenoid relief valve 46 can discharge the hydraulic oil from the bottom-side oil chamber of the boom cylinder 7 to the tank T, regardless of the operation state of the hydraulic oil holding circuit 40, that is, the communicating state or the non-communicating state of the spool valve 44 (oil passage 902). In other words, the hydraulic oil holding function of the hydraulic oil holding circuit 40, that holds the hydraulic oil in the bottom-side oil chamber of the boom cylinder 7, prevents the boom 4 from dropping, while discharging the hydraulic oil in the bottom-side oil chamber of the boom cylinder 7 to the tank T, regardless of whether or not the boom lowering operation is performed, thereby reducing excessive bottom pressure.

Moreover, in this example, similar to the second example illustrated in FIG. 10, the hose burst determination sensor 34, including pressure sensors 34A1 and 34A2, is provided.

As described above, the controller 30 determines whether or not the unstable action of the excavator 100 is generated, or whether or not there is a possibility that the unstable action is generated, based on the detection information input from the unstable action determination sensor 32. When the controller 30 (control section 302) determines that the unstable action (rear portion lifting action or vibrating action) is generated, there is a possibility that the unstable action (rear portion lifting action or vibrating action) is generated, the controller 30 (control section 302) outputs the control current to the solenoid relief valve 46, to cancel the hydraulic oil holding function of the hydraulic oil holding circuit 40, thereby performing the bottom relief control. Accordingly, similar to the case of the second example illustrated in FIG. 10, since restriction of the flow rate of the hydraulic oil flowing out of the boom cylinder 7 is relaxed, the controller 30 can more appropriately adjust (reduce) the excessive pressure in the bottom-side oil chamber of the boom cylinder 7, and further reduce the unstable action of the excavator 100.

In addition, similar to the case of the second example illustrated in FIG. 10, the controller 30 determines, during the bottom relief control, the presence or absence of the hose burst, based on the detection information from the hose burst determination sensor 34. When the controller 30 determines that the hose burst occurred, the controller 30 stops the bottom relief control by stopping the output of the control current to the solenoid relief valve 46, and stops the canceling of the hydraulic oil holding function of the hydraulic oil holding circuit 40, that is, restores the hydraulic oil holding function. Accordingly, the controller 30 can simultaneously prevent the boom 4 from dropping when the hose burst occurs, and reduce the unstable action of the excavator 100.

[Process Flow Related to Bottom Relief Control]

Next, a process flow related to the bottom relief control by the controller 30, will be described with reference to FIG. 12 and FIG. 13.

Figure 12:
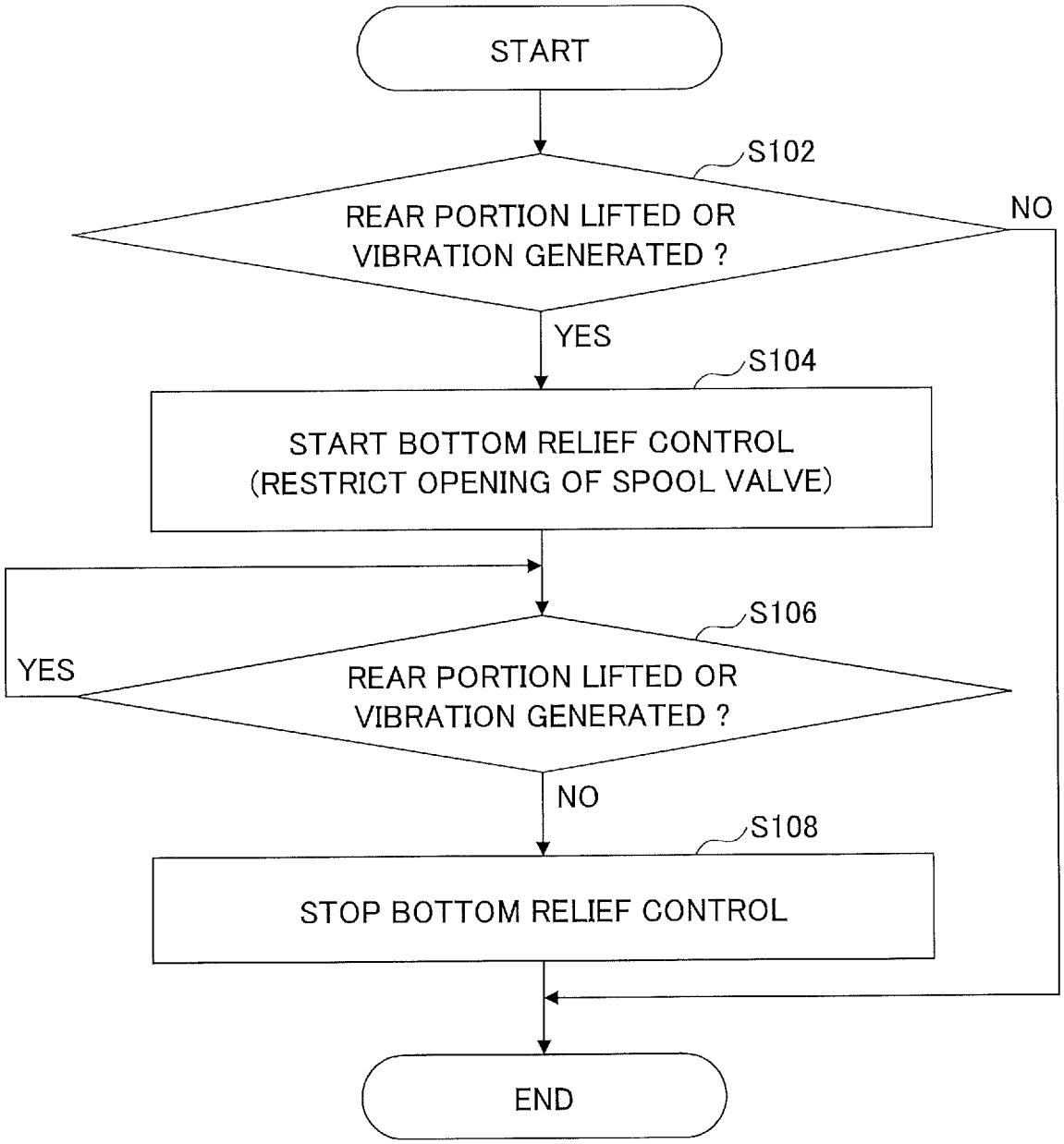
FIG. 12 is a flow chart schematically illustrating an example of a process related to the bottom relief control by a controller.

First, FIG. 12 is a flow chart schematically illustrating an example of the process related to the bottom relief control by the controller 30, more particularly, the process related to the bottom relief control corresponding to the configuration of the first example illustrated in FIG. 9 described above. The process according to this flow chart is repeated at predetermined processing intervals, for example, during the operation from the start to the stop of the excavator 100, in a case where the bottom relief control is not performed. In the following, the same applies to the flow chart illustrated in FIG. 13.

In step S102, the determination section 301 determines whether or not the unstable action subject to the bottom relief control, that is, the rear portion lifting action or the vibrating action, is generated in the excavator 100. When the unstable action that is subject to the bottom relief control is generated in the excavator 100, the determination section 301 proceeds to step S104, but otherwise ends the current process. In this step S102, the determination section 301 may determine whether or not there is a possibility that the unstable action subject to the bottom relief control is generated in the excavator 100, as described above. The same applies to step S202 in FIG. 13 which will be described later.

In step S104, the control section 302 outputs the control current to the solenoid proportional valve 52 and the solenoid relief valve 58, and starts the bottom relief control. In this state, the control section 302 outputs to the solenoid proportional valve 52 the control current that restricts an opening of the spool valve 44 (restricts the oil passage 902), as described above. Hence, as described above, because it is possible to limit the flow rate of the hydraulic oil flowing out of the bottom-side oil chamber of the boom cylinder 7, even when the hose burst occurs during the bottom relief control, the acting velocity of the boom 4 in the lowering direction can be reduced to become low relatively, thereby preventing the dropping of the boom 4.

In step S106, the determination section 301 determines whether or not the unstable action subject to the bottom relief control continues in the excavator 100. In a case where the unstable action subject to the bottom relief control does not continue in the excavator 100, the determination section 301 proceeds to step S108. But when the unstable action subject to the bottom relief control continues in the excavator 100, the determination section 301 repeats the process of this step S106 until the determination section 301 determines that no unstable action is generated.

In the case where the determination section 301, in step S102, determines whether or not there is a possibility that the unstable action subject to the bottom relief control is generated in the excavator 100, as described above, the determination section 301 similarly determines, in step S106, whether or not there is a possibility that the unstable action is generated in the excavator 100. The same applies to step S206 in FIG. 13 which will be described later.

In step S108, the control section 302 stops the bottom relief control by stopping the output of the control current to the solenoid proportional valve 52 and the solenoid relief valve 58, and ends the current process.

Figure 13:
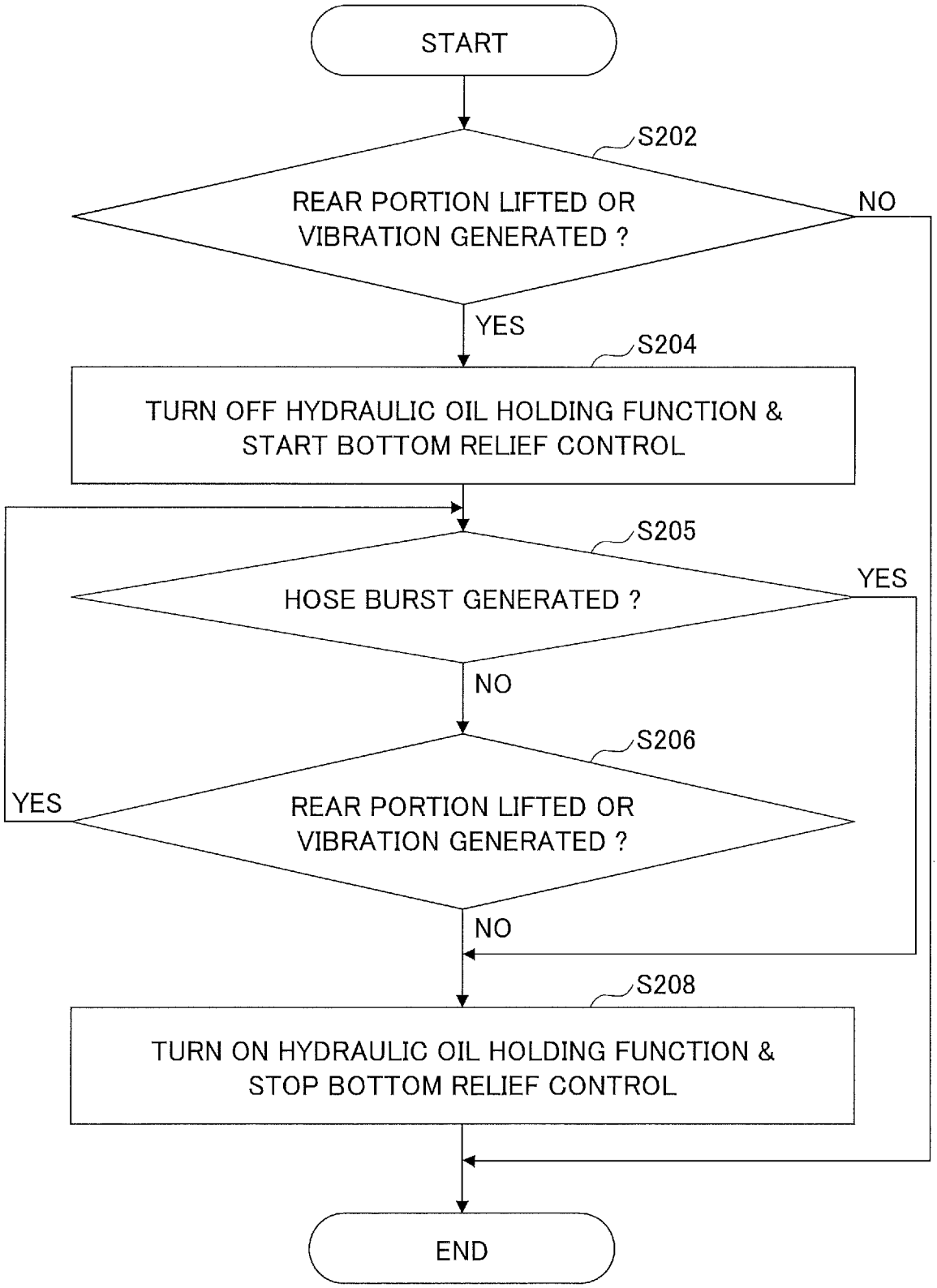
FIG. 13 is a flow chart schematically illustrating another example of the process related to the bottom relief control by the controller.

Next, FIG. 13 is a flow chart schematically illustrating another example of the process related to the bottom relief control by the controller 30, more particularly, the process related to the bottom relief control corresponding to the configuration of the second example and the third example illustrated in FIG. 10 and FIG. 11 described above.

Since the process of step S202 is the same as that of step S102 in FIG. 12, a description thereof will be omitted.

In step S204, the control section 302 outputs a control current to the solenoid proportional valve 52 and the solenoid relief valve 58 or the solenoid relief valve 46, to cancel (turn off) the hydraulic oil holding function of the hydraulic oil holding circuit 40, and start the bottom relief control. In other words, unlike the case of step S104 in FIG. 12, the control section 302 does not limit the flow rate of the hydraulic oil flowing out of the bottom-side oil chamber of the boom cylinder 7. Accordingly, it is possible to increase the pressure adjustment range of the pressure in the bottom-side oil chamber of the boom cylinder 7 during the bottom relief control, and it is possible to more appropriately reduce the unstable action of the excavator 100.

In step S205, the determination section 301 determines whether or not the hose burst occurred. When the determination section 301 determines that no hose burst occurred, the determination section 301 proceeds to step S206. On the other hand, when the determination section 301 determines that the hose burst occurred, the determination section 301 proceeds to step S208.

In step S206, the determination section 301 determines whether or not the unstable action subject to bottom relief control continues in the excavator 100. When the determination section 301 determines that the unstable action subject to the bottom relief control does not continue in the excavator 100, the determination section 301 proceeds to step S208. When the determination section 301 determines that the unstable action subject to the bottom relieve control continues in the excavator 100, the determination section 301 returns to step S205, and repeats the processes of steps S205 and S206.

In step S208, the control section 302 stops the output of the control current to the solenoid proportional valve 52 and the solenoid relief valve 58 or the solenoid relief valve 46, to stop the bottom relief control, and also restores (turns on) the hydraulic oil holding function of the hydraulic oil holding circuit 40, to end the current process. Accordingly, even when the hose burst occurs during the bottom relief control (in the case of Yes in step S205), the controller 30 can hold the hydraulic oil in the bottom-side oil chamber of the boom cylinder 7 by the hydraulic oil holding circuit 40, and prevent the boom 4 from dropping.

According to the embodiments described above, it is possible provide an excavator capable of simultaneously preventing dropping of the boom and automatically controlling the pressure of the boom cylinder.

It should be understood that the invention is not limited to the above described embodiments, but may be modified into various forms on the basis of the spirit of the invention. Additionally, the modifications are included in the scope of the invention.

For example, in the above described embodiments, the excavator 100 is configured to hydraulically drive all of the various elements to be driven, such as the undercarriage 1, the clewing upper structure 3, the boom 4, the arm 5, and the bucket 6, or the like, however, some of the elements of the excavator 100 may be driven electrically. In other words, the configuration or the like disclosed by the above described embodiments may be applied to a hybrid excavator, an electric excavator, or the like.

What is claimed is:

1. An excavator comprising:

an undercarriage;

an slewing upper structure rotatably mounted on the undercarriage;

attachments, mounted on the slewing upper structure, and including a boom, an arm, and an end attachment;

a boom cylinder configured to drive the boom;

a first hydraulic mechanism configured to control supply and discharge of a hydraulic oil to the boom cylinder according to an operation of the boom;

a second hydraulic mechanism, provided in an oil passage between a bottom-side oil chamber of the boom cylinder and the first hydraulic mechanism, and configured to close when a lowering operation of the boom is not performed, and to open when the lowering operation of the boom is performed; and a processor configured to determine whether or not the excavator assumes a predetermined unstable action state when an overturning moment urging the excavator to overturn is transferred from one of the attachments to the slewing upper structure due to a change in a moment of inertia of the one of the attachments, release the second hydraulic mechanism from a closed state to an open state when the excavator is determined to, assume the predetermined unstable action state even while the lowering operation of the boom is not performed, and control the open state of the second hydraulic mechanism so that an acting velocity in a lowering direction of the boom is less than or equal to a predetermined reference, wherein the second hydraulic mechanism enables a flow of the hydraulic oil in the open state thereof, and disables the flow of the hydraulic oil in the closed state, thereof.

2. The excavator as claimed in claim 1, wherein the acting velocity includes an average acting velocity in the lowering direction of the boom.

3. The excavator as claimed in claim 1, wherein the acting velocity includes a displacement in a lowering direction of the boom within a predetermined time.

4. The excavator as claimed in claim 1, wherein the second hydraulic mechanism includes a holding valve configured to tolerate a flow of the hydraulic oil into the bottom-side oil chamber, and block a discharge of the hydraulic oil from the bottom-side oil chamber, thereby holding the hydraulic oil in the bottom-side oil chamber, and a first discharge valve linked to an operation state of the boom and configured to discharge the hydraulic oil from the bottom-side oil chamber.

5. The excavator as claimed in claim 4, wherein the processor temporarily releases a link between the operation state of the boom and the first discharge valve when the excavator is determined to be in the predetermined unstable action state, and releases the second hydraulic mechanism from the closed state to the open state by controlling the first discharge valve.

6. The excavator as claimed in claim 4, wherein the second hydraulic mechanism further includes a second discharge valve configured to discharge the hydraulic oil from the bottom-side oil chamber, and the processor controls the second discharge valve when the excavator is determined to be in the predetermined unstable action state, to release the second hydraulic mechanism from the closed state to the open state.

7. The excavator as claimed in claim 1, further comprising:

a detector configured to detect information related to the predetermined unstable action state of the excavator, wherein the processor is configured to determine whether or not the excavator is in the predetermined unstable action state based on the information detected by the detector.

8. The excavator as claimed in claim 7, wherein the predetermined unstable action state of the excavator includes a lifting action in which a rear portion of the excavator is lifted due to an excavating reaction force, and a vibrating action of the undercarriage or the slewing upper structure induced by the change in the moment of inertia during an in-air operation of one of the attachments.

9. The excavator as claimed in claim 8, wherein the in-air operation of one of the attachments includes an operation in a state where the end attachment is not grounded.

10. The excavator as claimed in claim 7, wherein the information is related to at least one of an attitude angle of the boom, an attitude angle of the arm, an attitude angle of the end attachment, a hydraulic pressure in the bottom-side oil chamber, and an operation state of each of the undercarriage, the slewing upper structure, and the attachments.

11. The excavator as claimed in claim 1, wherein the processor is configured to determine whether or not the excavator assumes the predetermined unstable action state when a moment in a pitching direction causing the undercarriage and the slewing upper structure to roll frontward is transferred from the one of the attachments to the stewing upper structure due to the change in the moment of inertia of the one of the attachments.

12. An excavator comprising:

an undercarriage;

an slewing upper structure rotatably mounted on the undercarriage;

attachments, mounted on the slewing upper structure, and including a boom, an arm, and an end attachment;

a boom cylinder configured to drive the boom;

a first hydraulic mechanism configured to operate according to, an operation of the attachments;

a second hydraulic mechanism, provided in an oil passage between a bottom-side oil chamber of the boom cylinder and the first hydraulic mechanism, and configured to close when a lowering operation of the boom is not performed;

a detector configured to detect information related to a leak of a hydraulic oil in the oil passage on a downstream side opposite to the bottom-side oil chamber when viewed from the second hydraulic mechanism; and a processor configured to release the second hydraulic mechanism from a closed state to an open state when the excavator is in a predetermined unstable state, and control the open state so that, an acting velocity in a lowering direction of the boom is less than or equal to a predetermined reference, wherein the processor determines whether the leak of the hydraulic oil is generated in the oil passage on the downstream side of the second hydraulic mechanism, based on the information detected by the detector, when the second hydraulic mechanism is released from the closed state to the open state, and controls the open state of the second hydraulic mechanism so that the acting velocity becomes less than or equal to the predetermined reference, when the leak of the hydraulic oil is determined to be generated.

13. The excavator as claimed in claim 12, wherein the detector detects the leak of the hydraulic oil in the oil passage on the downstream side of the second hydraulic mechanism.

14. The excavator as claimed in claim 13, wherein the detector includes a first pressure sensor configured to detect an oil pressure in the oil passage between the bottom-side oil chamber and the second hydraulic mechanism, and a second pressure sensor configured to detect a pressure in the oil passage on the downstream side of the second hydraulic mechanism.

15. The excavator as claimed in claim 12, wherein the detector detects an operation of the excavator related to the leak of the hydraulic oil in the oil passage on the downstream side of the second hydraulic mechanism.

16. The excavator as claimed in claim 15, wherein the detector includes at least one of an inertial sensor configured to detect at least one of an acceleration and an angular acceleration of the boom, a cylinder sensor configured to detect at least, one of a piston position, a velocity, and an acceleration of the boom cylinder, and an angle sensor configured to detect a pitch angle of the boom with respect to the slewing upper structure.

* * * * *